US008958717B2

(12) United States Patent
Matsuda

(10) Patent No.: US 8,958,717 B2
(45) Date of Patent: Feb. 17, 2015

(54) CLEANING APPARATUS, CARTRIDGE, IMAGE FORMING APPARATUS, AND ELASTIC SEAL

(71) Applicant: Canon Kabushiki Kaisha, Tokyo (JP)

(72) Inventor: Kenji Matsuda, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 13/954,384

(22) Filed: Jul. 30, 2013

(65) Prior Publication Data

US 2014/0037324 A1 Feb. 6, 2014

(30) Foreign Application Priority Data

Aug. 1, 2012 (JP) ..... 2012-171033

(51) Int. Cl.
*G03G 15/08* (2006.01)
*G03G 21/00* (2006.01)

(52) U.S. Cl.
CPC ..... *G03G 21/0011* (2013.01); *G03G 15/0817* (2013.01); *G03G 21/0029* (2013.01)
USPC ..... 399/102

(58) Field of Classification Search
CPC ..... G03G 15/0817
USPC ..... 399/102, 103, 105, 106
See application file for complete search history.

(56) References Cited

U.S. PATENT DOCUMENTS

| | | | | |
|---|---|---|---|---|
| 5,502,547 | A * | 3/1996 | Shirai | 399/102 |
| 5,774,765 | A * | 6/1998 | Hirota et al. | 399/102 |
| 2003/0235427 | A1 * | 12/2003 | Bloemen et al. | 399/102 |
| 2012/0163855 | A1 * | 6/2012 | Seo et al. | 399/102 |
| 2014/0072326 | A1 * | 3/2014 | Yamaguchi et al. | 399/102 |
| 2014/0086618 | A1 * | 3/2014 | Shimizu et al. | 399/102 |

FOREIGN PATENT DOCUMENTS

| | | | |
|---|---|---|---|
| JP | H04-003458 | U | 1/1992 |
| JP | 6-27861 | A | 2/1994 |
| JP | H07-092887 | A | 4/1995 |
| JP | H07-121085 | A | 5/1995 |
| JP | H08-179611 | A | 7/1996 |
| JP | H08-202242 | A | 8/1996 |
| JP | 2004-085957 | A | 3/2004 |
| JP | 2005-121990 | A | 5/2005 |
| JP | 2009-063884 | A | 3/2009 |
| JP | 2009-265409 | A | 11/2009 |

* cited by examiner

*Primary Examiner* — Walter L Lindsay, Jr.
*Assistant Examiner* — Rodney Bonnette
(74) *Attorney, Agent, or Firm* — Canon USA Inc. IP Division

(57) ABSTRACT

A pair of elastic seals disposed at both ends of a cleaning blade of a cleaning apparatus include a back surface contact portion that is in contact with a back surface of the cleaning blade, a drum contact portion that is in contact with a photosensitive drum, and a side end surface facing portion connecting the back surface contact portion to the drum contact portion. Where the distance between one side end surface and another side end surface of the cleaning blade is L0, the distance on a side adjacent to the back surface contact portion, between the side end surface facing portion of one elastic seal and the side end surface facing portion of another elastic seal is L1, and the distance on a side adjacent to the drum contact portion is L2, L1<L0<L2.

20 Claims, 18 Drawing Sheets

CLEANING APPARATUS, CARTRIDGE, IMAGE FORMING APPARATUS, AND ELASTIC SEAL

BACKGROUND OF THE INVENTION

1. Field of the Invention

The present invention relates to a cleaning apparatus configured to remove a residue from a surface of a rotatable image bearing member of an image forming apparatus on which a developer image is formed. The present invention also relates to a cartridge including a cleaning apparatus, an image forming apparatus including a cleaning apparatus, and an elastic seal for use in a cleaning apparatus.

An image forming apparatus forms an image on a recording medium using an image forming process. Examples of an image forming apparatus include copying machines, printers (e.g., laser beam printer, LED printer), facsimile apparatuses, multifunctional devices thereof, and word processors.

Examples of an image forming process include an electrophotographic image forming process using an electrophotographic photosensitive member as an image bearing member, an electrostatic recording image forming process using an electrostatic recording dielectric member as an image bearing member, and a magnetic recording image forming process using a magnetic recording magnetic member as an image bearing member.

An image forming apparatus of a transfer method transfers a developer image formed on an image bearing member onto a recording material, or transfers a developer image formed on an image bearing member onto a recording material via an intermediate transfer member as a second image bearing member, to output an image formed product. A developer and other residues remaining on a surface of the image bearing member or the intermediate transfer member as the second image bearing member after the transfer of a developer image onto a recording material are removed (cleaned) by a cleaning apparatus to use the image bearing member or the intermediate transfer member repeatedly in image formation.

Examples of an image forming apparatus include an image display apparatus (e.g., display apparatus, electronic black board apparatus, electronic white board apparatus) that displays on a display unit a developer image formed on an image bearing member or a developer image transferred on an intermediate transfer member. In an image display apparatus, a developer image after being formed on an image bearing member or an intermediate transfer member and displayed on a display unit is removed from the image bearing member or the intermediate transfer member by the cleaning apparatus to use the image bearing member or the intermediate transfer member repeatedly in image formation. As necessary, the developer image after being formed on the image bearing member or the intermediate transfer member and displayed on the display unit is transferred onto a recording material to output an image formed product.

The image bearing member, the intermediate transfer member, and the recording material in the image forming apparatuses described above are collectively referred to as a recording medium on which a developer image is to be formed by an image forming process.

2. Description of the Related Art

A cleaning apparatus of a blade cleaning method for use in an electrophotographic image forming apparatus includes a cleaning blade. A front edge of the cleaning blade is brought into contact with a surface of a photosensitive drum as an image bearing member to scrape residues. The cleaning apparatus also includes a cleaning frame member that supports the cleaning blade and collects the scraped residues. The cleaning apparatus further includes a pair of side seals disposed at both sides of the cleaning blade in the longitudinal direction to prevent the residues from leaking from the cleaning frame member.

There is known a structure of a side seal of a cleaning apparatus including an auxiliary sealing member, which is in contact with a back surface of a cleaning blade, and an end seal member, which is in contact with a side end surface of the cleaning blade (Japanese Patent Application Laid-Open No. 2005-121990).

In the foregoing structure, the end seal is bonded after the cleaning blade is attached. Thus, the end seal can be bonded to fit the side end surface of the cleaning blade. In other words, an advantageous effect of preventing residues from leaking from the cleaning frame member is significantly high.

There is also known a method of configuring a side seal by applying a liquid sealing member onto a cleaning frame member and then attaching a cleaning blade and a photosensitive drum to spread the liquid sealing member before the liquid sealing member solidifies (Japanese Patent Application Laid-Open No. 2009-265409).

In the foregoing configuration, the liquid sealing member is spread by a component such as the cleaning blade to come into close contact with the cleaning blade and the cleaning frame member. Thus, the advantageous effect of preventing residues from leaking from the cleaning frame member is significantly high.

There is also known a method in which either a side end surface of a cleaning blade or a sealing member facing the side end surface is provided with a tapered surface, and the side end surface of the cleaning blade and the sealing member are engaged wedgewise to come into close contact with each other, thereby securing sealing properties (Japanese Patent Application Laid-Open No. 6-27861).

With the foregoing configuration, sealing properties of the side end surface of the cleaning blade and the sealing member facing the side end surface can be secured.

SUMMARY OF THE INVENTION

The present invention is a result of further development of the foregoing conventional techniques. Specifically, the present invention is directed to a cleaning apparatus that secures adequate sealing properties with a smaller number of components than a conventional cleaning apparatus. The present invention is also directed to a cartridge including the foregoing cleaning apparatus, and an image forming apparatus including the foregoing cleaning apparatus. The present invention is further directed to an elastic seal for use in a cleaning apparatus.

According to an aspect of the present invention, a cleaning apparatus includes: a cleaning blade being in contact with a surface of an image bearing member to remove a residue from the surface of the image bearing member wherein a developer image is formed on the surface of the image bearing member; and a cleaning frame member including a residue collecting unit configured to collect the residue removed by the cleaning blade, wherein the cleaning apparatus comprises an elastic seal disposed at an end portion of the cleaning blade in a longitudinal direction, wherein the elastic seal is an integrated seal including an image bearing member contact portion and a side end surface facing portion that faces a side end surface of the cleaning blade and includes a side end surface contact portion which comes into contact with the side end surface of the cleaning blade when the cleaning blade is attached to the cleaning frame member, wherein a distance between the side end surface facing portion of the elastic seal and a corresponding portion on another side that corresponds to the side end surface facing portion, is set longer at least on a side adjacent to the image bearing member contact portion than a longitudinal dimension of the cleaning blade, and wherein a distance between the side end surface contact portion of the elastic seal and a corresponding portion on another side that corresponds to the side end surface contact portion is set shorter than the longitudinal dimension of the cleaning blade.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Unless otherwise specified, the shapes and relative arrangements of constituent components described in the following exemplary embodiments are not intended to limit the scope of the invention.

[Summary of Exemplary Image Forming Apparatus]

Figure 1:
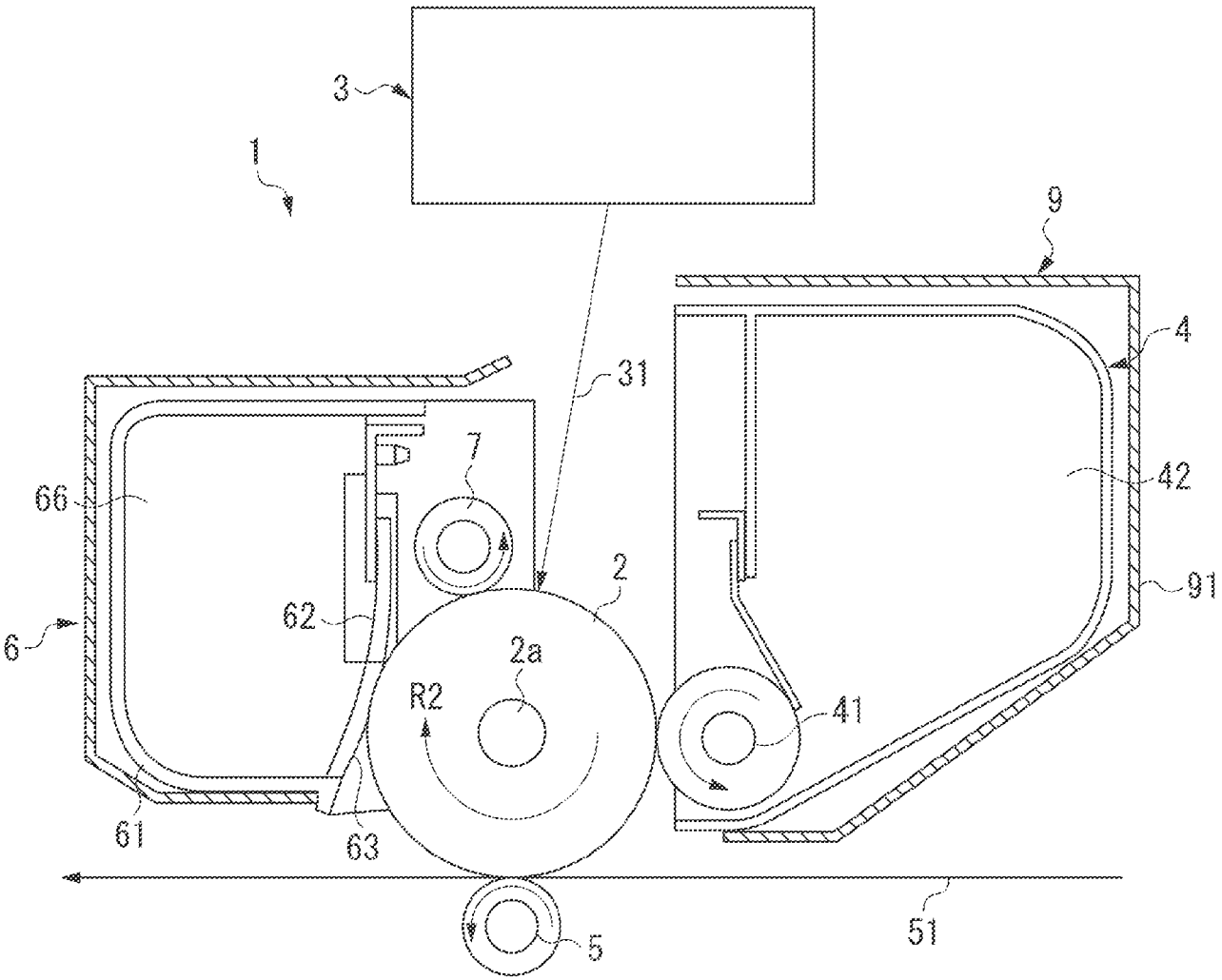
FIG. 1 is a schematic view illustrating a structure of a main portion of an image forming apparatus according to a first exemplary embodiment.

FIG. 1 is a schematic view illustrating a structure of a main portion of an image forming apparatus 1 according to a first exemplary embodiment. The image forming apparatus 1 is an electrophotographic image forming apparatus. A drum-type electrophotographic photosensitive member 2 (hereinafter, referred to as "drum 2") is a rotatable image bearing member including on a surface of a drum body a photosensitive layer made of an organic photosensitive member. The drum 2 is horizontally held and arranged to be rotatably supported by a central shaft 2*a* held. The direction of the central shaft is a longitudinal direction of the drum 2.

In FIG. 1, an exposure device 3, which is an electrostatic latent image forming unit, is disposed on the upper side of the drum 2. A development unit 4, which is a developing unit, is disposed on the right-hand side of the drum 2. A transfer roller 5, which is a transfer unit, is disposed on the lower side of the drum 2. A cleaning apparatus 6 is disposed on the left-hand side of the drum 2. A charging roller 7, which is a charging unit, is disposed on the upper left side of the drum 2.

An image formation operation is as follows. The drum 2 is rotationally driven clockwise in the direction of an arrow R2 at a predetermined circumferential speed (process speed). The charging roller 7 is a conductive elastic member that is disposed parallel to the rotation shaft line of the drum 2, and is in contact with a surface of the drum 2 by predetermined pressing force. The charging roller 7 is driven and rotated by the rotation of the drum 2. A predetermined charging bias is applied to the charging roller 7, whereby the surface of the drum 2 is uniformly contact-charged to a predetermined polarity and a predetermined potential while the drum 2 is rotating.

An image is exposed to the charged surface of the drum 2 by an exposure unit 3. In the present exemplary embodiment, the exposure unit 3 is a laser scanner and outputs laser light 31, which is modulated according to time-sequential digital electric signals of image information for forming the image. The laser scanner performs main scanning to expose the surface of the rotating drum 2 in the generatrix direction of the drum 2, whereby an electrostatic latent image corresponding to an exposure pattern is formed on the surface of the drum 2.

The electrostatic latent image is developed as a developer image (toner image) by the development unit 4. The development unit 4 includes a developer storage unit 42, which stores a developer inside, and a development roller 41 as a development member. The development roller 41 is disposed parallel to the rotation shaft line of the drum 2. The development roller 41 is in contact with the surface of the drum 2 by predetermined pressing force or faces the surface of the drum 2 with a significantly small space without touching the surface of the drum 2. During execution of an image forming process, the development roller 41 is driven and rotated anticlockwise of the arrow at a predetermined circumferential speed, bears the developer stored in the developer storage unit 42, and applies the developer to the surface of the drum 2. A predetermined development bias is applied to the development roller 41.

Consequently, the developer is developed according to the electrostatic latent image formed on the drum 2. Thus, the surface of the drum 2 bears a developer image.

The transfer roller 5 is a conductive elastic member that is disposed parallel to the rotation shaft line of the drum 2, and is in contact with the surface of the drum 2 by predetermined pressing force. The transfer roller 5 is driven and rotated by the rotation of the drum 2. A contact nip portion where the drum 2 and the transfer roller 5 are in contact with each other is a transfer unit. A recording material (transfer material) 51 is fed from a sheet feeding unit (not illustrated), introduced to the transfer unit at predetermined control timing, and sandwiched and conveyed. While the recording material 51 is passed through the transfer unit, a predetermined transfer bias is applied to the transfer roller 5, whereby the developer image on the surface of the drum 2 is sequentially electrostatically transferred onto the surface of the recording material 51.

The recording material 51 having exited the transfer unit is separated from the surface of the drum 2 and introduced to a fixing device (not illustrated) to fix the developer image. The recording material with the fixed image is discharged as an image formed product to the outside of the image forming apparatus 1.

The developer of the developer image held on the drum 2 that has not been transferred onto the recording material 51 by the transfer unit is conveyed, adhering to the drum 2 as a residue on the drum surface, in the direction of the cleaning apparatus 6 by the following rotation of the drum 2. Then, the developer, paper dust, and other residues remaining on the surface of the drum 2 are removed (cleaned) by the cleaning apparatus 6. In other words, the surface of the drum 2 is cleaned to be used repeatedly in image formation.

The cleaning apparatus 6 is an apparatus of blade cleaning type and includes a cleaning frame member 61, a cleaning blade 62, and a scooping sheet 63. The residue remaining on the surface of the drum 2 is scraped by the cleaning blade 62. The scooping sheet 63 guides the scraped residue to a residue storage unit 66 formed inside the cleaning frame member 61, and the scraped residue is stored in the residue storage unit 66.

The electrophotographic image forming apparatus 1 can perform continuous image formation by repeating the foregoing image forming process operation including charging, exposure, development, transfer, and cleaning with respect to the drum 2.

A cartridge 9 is removably attached to a main body of the image forming apparatus 1. In the present exemplary embodiment, the cartridge 9 is a process cartridge in which four processing devices including the drum 2, the charging roller 7, the development unit 4, and the cleaning apparatus 6 are incorporated in a common cartridge frame member 91. The cartridge 9 can be attached to and removed from a predetermined attachment portion of the main body of the image forming apparatus 1 in a predetermined way. When attached to the main body of the image forming apparatus 1, the cartridge 9 is mechanically and electrically connected to the main body of the image forming apparatus 1, whereby the image forming apparatus 1 can perform the image forming operation.

[Cleaning Apparatus 6]

Figure 2:
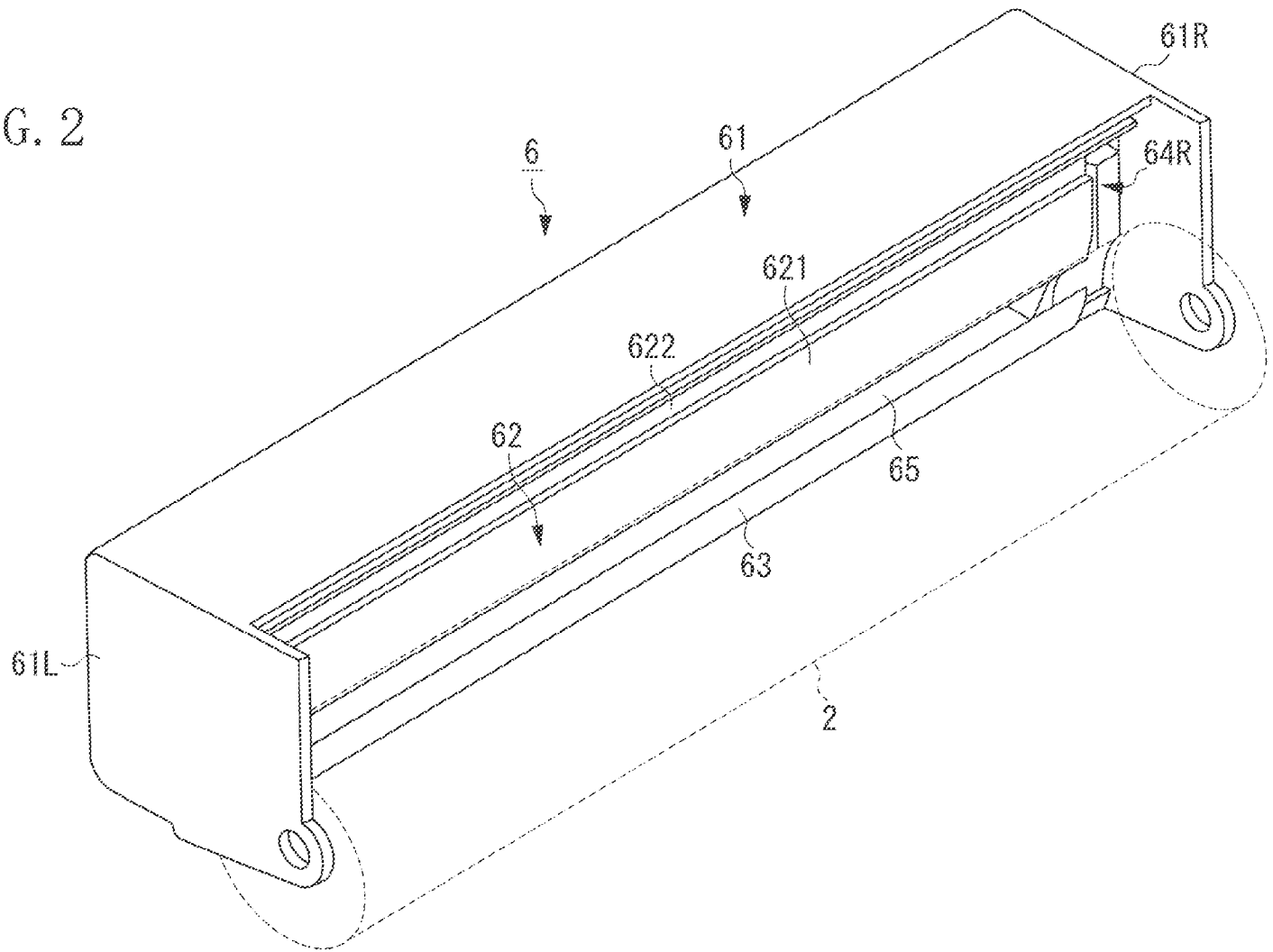
FIG. 2 is a perspective view of a cleaning apparatus.
Figure 3:
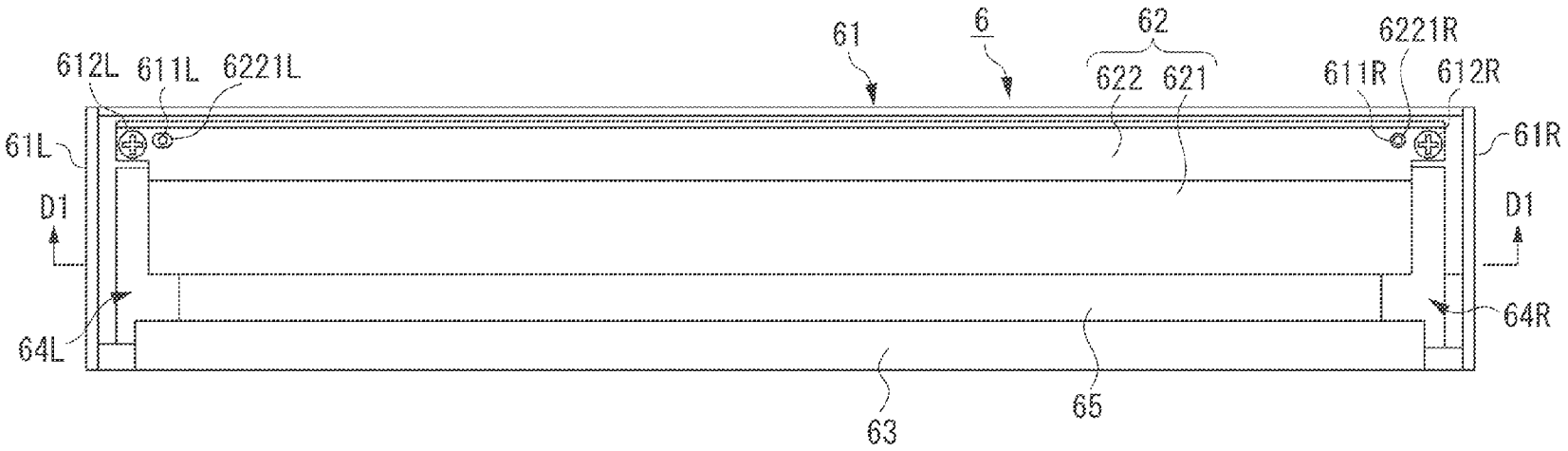
FIG. 3 is a front view of the cleaning apparatus.

The following describes the cleaning apparatus 6 in detail with reference to FIGS. 2 and 3. The front surface side of the cleaning apparatus 6 is a side facing the drum 2, which is an image bearing member. The terms "front side" and "near side" are used interchangeably with the term "front surface side." The back surface side is an opposite side to the front surface side. The terms "back side" and "rear side" are used interchangeably with the term "back surface side." The term "left" or "right" refers to the left or the right of the image forming apparatus 1 viewed from the front surface side. The term "top" or "bottom" refers to the top or the bottom in the direction of gravity. The longitudinal direction refers to a horizontal direction parallel to the drum 2.

FIG. 2 is a perspective view illustrating the front surface side of the cleaning apparatus 6. FIG. 3 is a front view of the cleaning apparatus 6. The cleaning apparatus 6 is a rectangular apparatus having longer sides in the horizontal direction.

The cleaning apparatus 6 includes the cleaning blade 62 and the cleaning frame member 61 including the residue collecting unit 66 (FIG. 1). A front edge of the cleaning blade 62 is in contact with the surface of the drum 2 to remove residues from the surface of the drum 2. The residue collecting unit 66 collects the residues removed by the cleaning blade 62. The cleaning apparatus 6 also includes a pair of left and right elastic seals (side seals) 64L and 64R disposed at both end portions of the cleaning blade 62 in the longitudinal direction to prevent the residues from leaking from the residue collecting unit 66. The cleaning apparatus 6 further includes the scooping sheet 63.

The cleaning frame member (hereinafter, referred to as "frame member") 61 is a substantially rectangular plastic molded box article having longer sides in the horizontal direction with an opening portion on the front side. In the image forming apparatus 1 of the present exemplary embodiment, left and right side plates 61L and 61R of the frame member 61 extend to the near side from the front opening portion of the frame member 61 (FIG. 2). The drum 2 is rotatably borne and supported between the left and right extending portions, and the charging roller 7 is disposed to form a drum unit including the drum 2, the cleaning apparatus 6, and the charging roller 7 (FIG. 1).

The cleaning blade 62 is disposed on the upper side of the opening portion, which is the front side of the frame member 61. The scooping sheet 63 is disposed on the lower side of the opening portion. The pair of left and right elastic seals 64L and 64R are disposed on the left and right sides of the opening portion, respectively.

The cleaning blade 62 is a component having longer sides in the horizontal direction. The cleaning blade 62 includes a rubber member (cleaning blade) 621 and a supporting member 622 supporting the rubber member 621. A front edge portion of the rubber member 621 is in contact with the drum 2 in a counter direction. The left and right end portions of the supporting member 622 include positioning holes 6221L and 6221R, respectively. The positioning hole 6221L in the left end portion is an elongated hole that is slightly longer in the horizontal direction. The positioning hole 6221R in the right end portion is a circular hole.

Upper portions of the left and right end portions of the opening portion of the frame member 61 is provided with positioning bosses 611L and 611R, respectively. The positioning bosses 611L and 611R are positioning units of the cleaning blade 62.

The positioning holes 6221L and 6221R of the cleaning blade 62 are engaged with the positioning bosses 611L and 611R of the frame member 61, respectively. Then, the left and right portions of the supporting member 622 of the cleaning blade 62 are fixed to the frame member 61 with fixing screws 612L and 612R. As a result, the cleaning blade 62 is fixed and disposed such that the cleaning blade 62 is positioned on the upper side of the opening portion of the frame member 61 along the longitudinal direction of the opening portion with the rubber member 621 facing downward. Accordingly, the front edge portion of the downward rubber member 621 of the cleaning blade 62 is in contact with the surface of the drum 2 in the counter direction with respect to the drum rotation direction (direction in which the image bearing member rotates).

The scooping sheet 63 is an elastic (flexible) plastic sheet member having longer sides in the horizontal direction. A lower side (bottom side) of the scooping sheet 63 is bonded and fixed to a lower side of the opening portion of the frame member 61 (front edge of bottom plate of frame member 61) along the longitudinal direction. Accordingly, the scooping sheet 63 is fixed and disposed on the lower side of the opening portion of the frame member along the longitudinal direction to face upward. A front edge portion of the scooping sheet 63 is in contact with the surface of the drum 2 in the forward direction with respect to the drum rotation direction.

The pair of left and right elastic seals 64L and 64R are disposed at both ends (left end and right end) of the cleaning blade 62 in the longitudinal direction. An opening 65 is formed in an area surrounded by the rubber member 621 of the cleaning blade 62, the scooping sheet 63, and the pair of elastic seals 64L and 64R disposed at the left and right ends.

The residues remaining on the drum 2 are scraped by the rubber member 621 of the cleaning blade 62. The scraped residues enter the residue storage unit 66, which is formed in the frame member 61, from the opening 65 and are stored in the residue storage unit 66. The scooping sheet 63 covers a space between the drum 2 and the frame member 61 below the cleaning blade 62. An inner surface of the scooping sheet 63 receives the residues scraped by the rubber member 621 to guide the residues to the residue storage unit 66, whereby leakage of the residues to the outside is prevented.

[Structure of Elastic Seal 64]

Figure 4A:
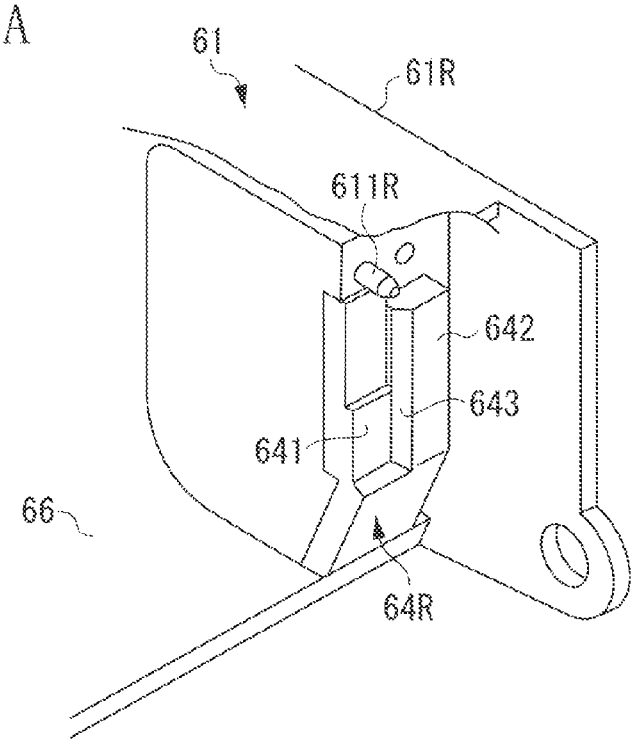
FIGS. 4A and 4B are partial enlarged views of a right elastic seal.
Figure 4B:
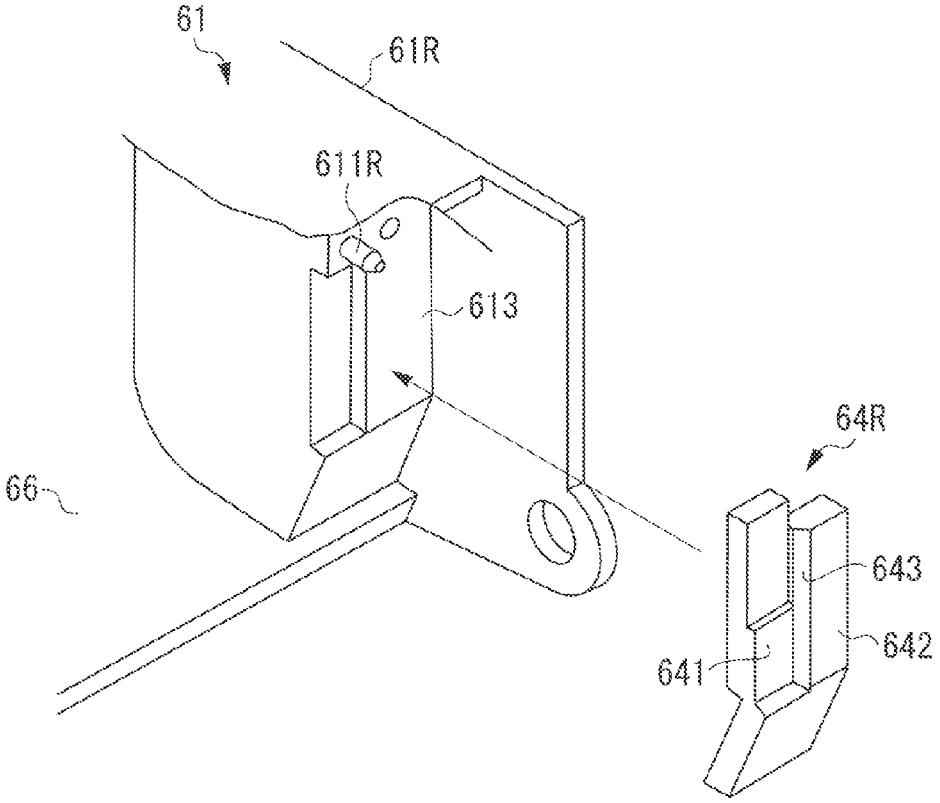
Figure 5A:
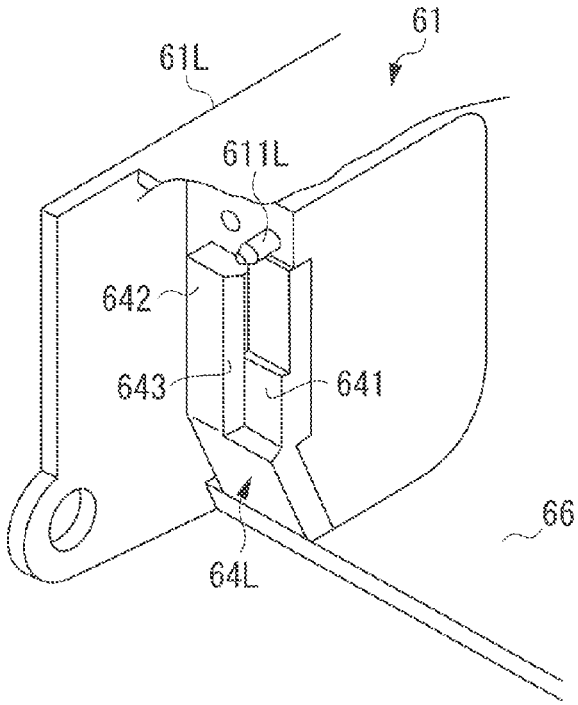
FIGS. 5A and 5B are partial enlarged views of a left elastic seal.
Figure 5B:
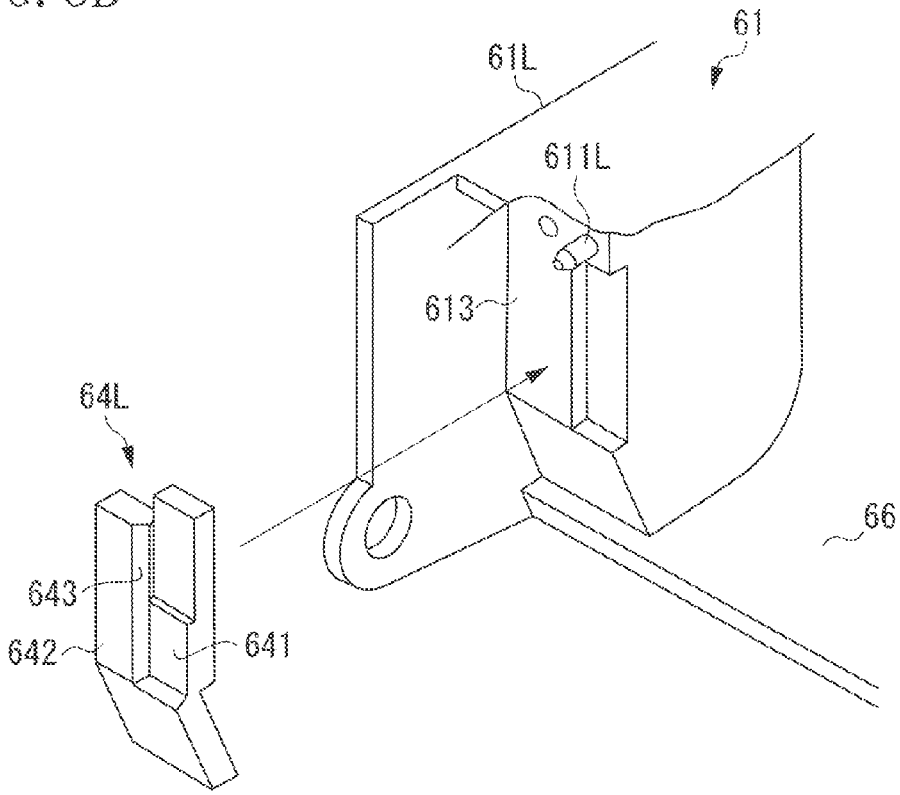

The following describes the elastic seal 64 (64L and 64R) with reference to FIGS. 4 and 5. FIG. 4A is a partial enlarged view illustrating the right elastic seal 64R portion of the cleaning apparatus 6 from which the cleaning blade 62 and the scooping sheet 63 are removed. FIG. 4A illustrates the right elastic seal 64R attached to the frame member 61. FIG. 4B illustrates a state where the right elastic seal 64R is attached. FIG. 5A is a partial enlarged view of the left elastic seal 64L portion. FIG. 5A illustrates the left elastic seal 64L attached to the frame member 61. FIG. 5B illustrates a state where the left elastic seal 64L is attached.

In the present exemplary embodiment, the left and right elastic seals 64L and 64R are symmetrical. The left and right elastic seals 64L and 64R are disposed at both end portions (left end portion and right end portion) of the cleaning blade 62 in the longitudinal direction, respectively. The front edge of the rubber member 621 of the cleaning blade 62, the scooping sheet 63, and the elastic seals 64L and 64R are in contact with the drum 2. In other words, the opening 65 is sealed by the front edge of the rubber member 621 of the cleaning blade 62, the scooping sheet 63, and the elastic seals 64L and 64R to prevent leakage of residues from the residue collecting unit 66 illustrated in FIG. 1 to the outside.

As illustrated in FIGS. 4A and 5A, the left and right elastic seals 64L and 64R are disposed at the left and right ends of the opening portion of the frame member 61, respectively. Each of the left and right elastic seals 64L and 64R includes a back surface contact portion 641, a drum contact portion (image bearing member contact portion) 642, and a side end surface facing portion 643.

The back surface contact portion 641 is in contact with a back surface of the rubber member 621 of the cleaning blade 62 to prevent leakage of residues from the back surface of the rubber member 621.

The drum contact portion 642 is in contact with the drum (image bearing member) 2 to prevent leakage of residues from the opening 65.

The side end surface facing portion 643 is positioned to connect the back surface contact portion 641 to the drum contact portion 642. The side end surface facing portion 643 faces a side end surface of the rubber member 621 of the cleaning blade 62.

The elastic seal 64 (64L and 64R) is an integrated sealing member including the back surface contact portion 641, the drum contact portion 642, and the side end surface facing portion 643.

[Attachment of Elastic Seal 64]

The following describes attachment of the elastic seal 64 (64L and 64R) with reference to FIGS. 4B and 5B. As illustrated in FIGS. 4B and 5B, a fixing seat surface 613 is formed at each of the left and right sides of the opening portion of the frame member 61. Then, the elastic seals 64L and 64R are bonded and fixed to the fixing seat surfaces 613.

An elastic seal formed by molding a thermoplastic foamed elastomer with a metallic mold is used as the elastic seal 64. Examples of a thermoplastic foamed elastomer include a thermoplastic foamed elastomer prepared by mixing a high pressure inert gas such as nitrogen with an ether based urethane resin.

Since the elastic seal 64 is molded, the back surface contact portion 641, the drum contact portion 642, and the side end surface facing portion 643 can be integrated (integrated sealing member) as illustrated in FIGS. 4B and 5B.

Especially, the side end surface facing portion 643 is required to be an inclined surface in the present exemplary embodiment. Thus, it is difficult to prepare the elastic seal 64 by cutting a foamed urethane sheet. However, as in the present exemplary embodiment, if the elastic seal 64 is molded, it is easy to form an elastic seal with a complicated shape.

Further, the cleaning apparatus 6 is assembled using an elastic seal having a stabilized shape after completion of a molding process. Thus, there would be no time constraint between the assembly of the elastic seal 64 and the assembly of the drum 2.

Even when the elastic seal according to the exemplary embodiment of the present invention is used only at one end of the cleaning blade 62 in the longitudinal direction and a different sealing member is used at the other end of the cleaning blade 62, the advantageous effect of reducing the number of components of the elastic seal at one end is produced.

[Longitudinal Dimensional Relationship Between Side End Surface Facing Portion and Cleaning Blade]

Figure 6A:
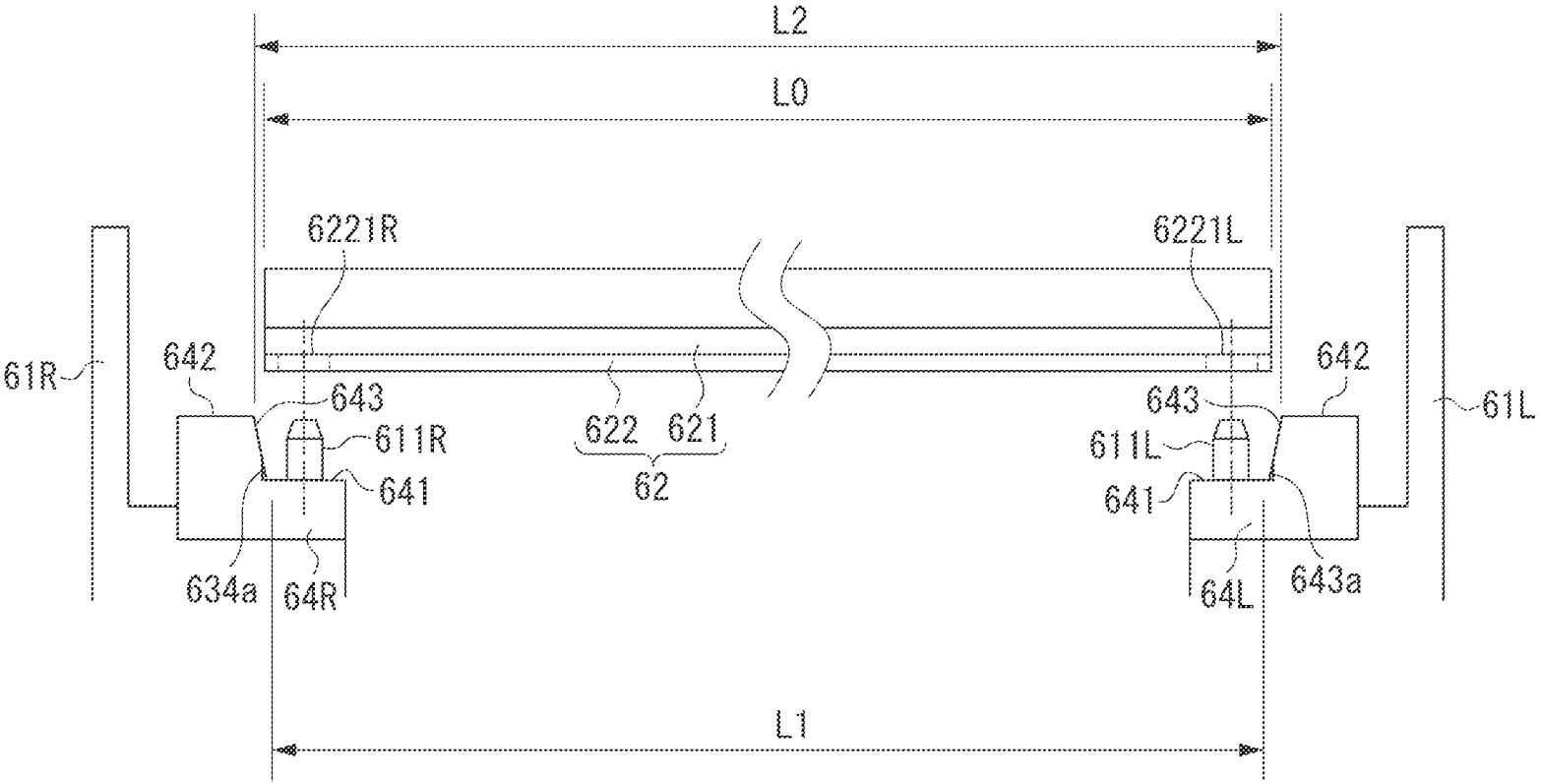
FIGS. 6A, 6B, and 6C are cross sectional views along the line D1-D1 indicated in FIG. 3, which schematically illustrate a process of attaching a cleaning blade to a cleaning frame member.
Figure 6B:
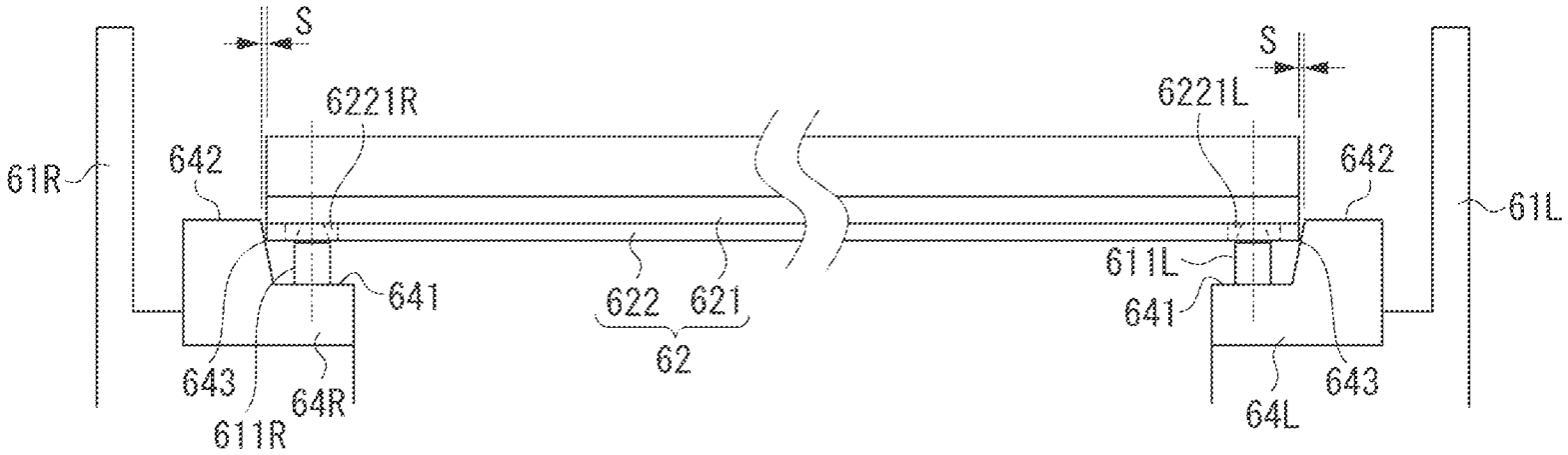
Figure 6C:
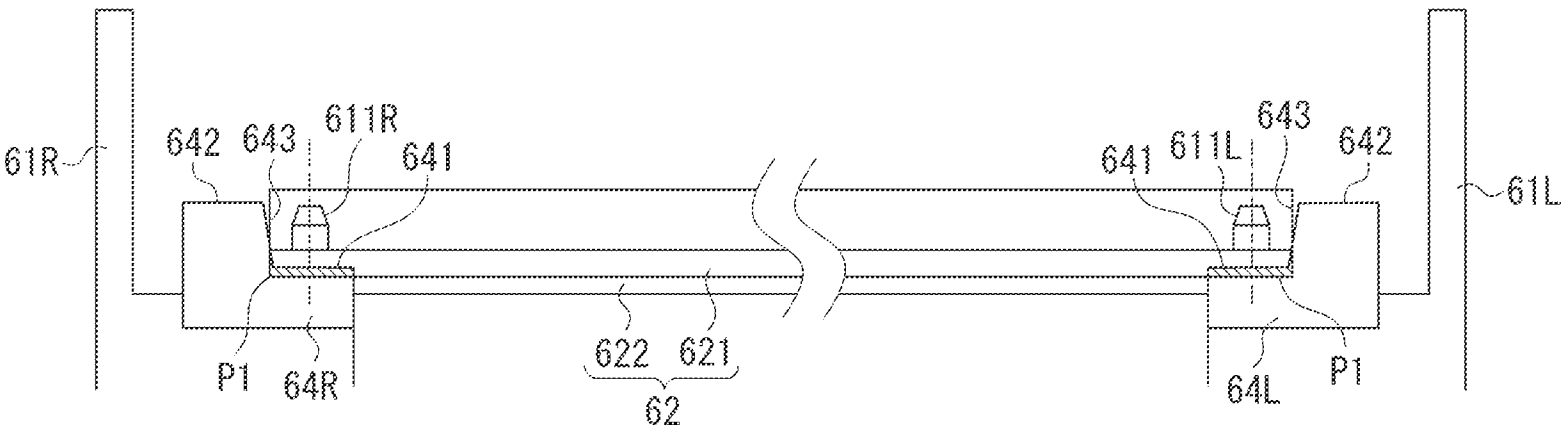

The following describes the longitudinal dimensional relationship between the side end surface facing portions 643 of the left and right elastic seals 64L and 64R attached to the left and right sides of the opening portion of the frame member 61 and the cleaning blade 62, with reference to FIGS. 6A, 6B, and 6C.

FIGS. 6A, 6B, and 6C are cross sectional views along the line D1-D1 indicated in FIG. 3. FIG. 6A illustrates a state before the cleaning blade 62 is attached to the frame member 61. FIG. 6B illustrates a state during a process of attaching the cleaning blade 62 to the frame member 61. FIG. 6B also illustrates a state in which the positioning holes 6221L and 6221R of the cleaning blade 62 start engaging with the positioning bosses 611L and 611R. FIG. 6C illustrates a state in which the cleaning blade 62 is attached to the frame member 61.

In the present exemplary embodiment, as illustrated in FIG. 6A, the side end surface facing portion 643 of each of the left and right elastic seals 64L and 64R is an inclined surface connecting the back surface contact portion 641 and the drum contact portion 642 together. The distance between the side end surface of the rubber member 621 of the cleaning blade 62 on the left side (one side) and the side end surface on the right side (another side), i.e., longitudinal dimension of the rubber member 621 (longitudinal dimension of cleaning blade 62), is denoted by L0.

The distance between the side end surface facing portions 643 of the left (one side) and right (another side) elastic seals 64L and 64R on the drum contact portion 642 side is denoted by L2. The distance between the side end surface facing portions 643 of the left and right elastic seals 64L and 64R on the back surface contact portion 641 side is denoted by L1. The relationship between L0, L1, and L2 is set to satisfy L1<L0<L2.

In the case of using the integrated elastic seal only at one end portion of the cleaning blade 62 and using a different sealing member at another end portion, each of the distances is a distance between each portion of the integrated elastic seal and a corresponding portion of the sealing member at another end portion. For example, the distance between the drum contact portion 642 side of the side end surface facing portion 643 of the integrated elastic seal and a corresponding portion side, which corresponds to the drum contact portion 642 side, of a corresponding portion, which corresponds to the side end surface facing portion 643 at another end portion is denoted by L2. However, for convenience of description, the portion that corresponds to the drum contact portion (image bearing member contact portion) side will be referred to as the drum contact portion (image bearing member contact portion) side in the following description.

As illustrated in FIG. 6A, when the cleaning blade 62 is attached to the frame member 61, the cleaning blade 62 is attached from the upper side of the positioning bosses 611L and 611R. As illustrated in FIG. 6B, when the cleaning blade 62 is attached, the positioning bosses 611L and 611R are engaged with the positioning holes 6221L and 6221R. At this time, the positions of the cleaning blade 62 and the frame member 61 in the longitudinal direction are determined. Since the relationship between the side end surface of the rubber member 621 of the cleaning blade 62 and the side end surface facing portion 643 is L0<L2, a space S is formed between the side end surface of the rubber member 621 of the cleaning blade 62 and the side end surface facing portion 643.

As illustrated in FIG. 6C, the positioning bosses 611L and 611R are engaged with the positioning holes 6221L and 6221R. Thus, the cleaning blade 62 is guided by the positioning bosses 611L and 611R to be attached to an attachment position. Then, the cleaning blade 62 is fixed to the frame member 61 with the fixing screws 612L and 612R (FIG. 3). At this time, the back surface of the rubber member 621 comes into contact with the back surface contact portion 641. Since the relationship between the side end surface of the rubber member 621 and the side end surface facing portion 643 is L1<L0, the side end surface of the rubber member 621 is in contact with the side end surface facing portion 643.

In the present exemplary embodiment, a side end surface contact portion 643*a*, which is in a range satisfying L1<L0, is set to satisfy a range equal to or greater than the thickness of the side end surface of the rubber member 621. Accordingly, when the cleaning blade 62 is attached to the frame member 61, the entire region of the side end surface of the rubber member 621 is in contact with the side end surface contact portion 643*a*.

Meanwhile, since the elastic seals 64L and 64R are elastic members, a compression region P1is compressed by the rubber member 621. In other words, the back surface and the side end surface of the rubber member 621 are in close contact with the elastic seal 64 to secure sealing properties.

The structure of the elastic seal 64 is summarized as follows. The elastic seal 64 is an integrated seal including the image bearing member contact portion 642, which is in contact with the drum 2, and the side end surface facing portion 643, which faces the side end surface of the cleaning blade 62. The side end surface facing portion 643 includes the side end surface contact portion 643*a*, which comes into contact with the side end surface of the cleaning blade 62 when the cleaning blade 62 is attached to the cleaning frame member 61.

The distance L2between the side end surface facing portion 643 of the elastic seal 64 (64L or 64R) and a corresponding portion on another side that corresponds to the side end surface facing portion 643 is set longer than the longitudinal dimension L0 of the cleaning blade 62 at least on the image bearing member contact portion 642 side. The distance L1 between the side end surface contact portion 643*a* of the elastic seal 64 (64L or 64R) and a corresponding portion on another side that corresponds to the side end surface contact portion 643*a* is set shorter than the longitudinal dimension L0 of the cleaning blade 62.

The elastic seal 64 includes the pair of elastic seals 64L and 64R disposed at one end side and another end side of the cleaning blade 62 in the longitudinal direction. The distance L2 between one side end surface facing portion 643 and another side end surface facing portion 643 of the pair of elastic seals is set longer than the longitudinal dimension (L0) of the cleaning blade 62 at least on the image bearing member contact portion 642 side. The distance L1 between one side end surface contact portion 643*a* and another side end surface contact portion 643*a* of the pair of elastic seals 64L and 64R is set shorter than the longitudinal dimension L0 of the cleaning blade 62.

The elastic seal 64 includes the back surface contact portion 641, which is brought into contact with the back surface of the cleaning blade 62. The back surface contact portion 641 is disposed downstream from the image bearing member contact portion 642 in the direction in which the cleaning blade 62 is attached.

The distance L1 between the side end surface contact portion 643*a* of the elastic seal 64 (64L or 64R) and a corresponding portion on another side that corresponds to the side end surface contact portion 643*a*, or the distance L1 between the one side end surface contact portion 643*a* and another side end surface contact portion 643*a* of the pair of elastic seals 64L and 64R, is set as follows. The distance L1 is set shorter than the longitudinal dimension L0 of the cleaning blade 62 at least in a region where a dimension from the back surface contact portion 641 is equal to or greater than the thickness of the side end surface of the cleaning blade 62.

[Sealing Properties of Side End Surface]

To prevent leakage of residues from the opening 65, it is important to seal the side end portion of the rubber member 621 of the cleaning blade 62.

According to a method discussed in Japanese Patent Application Laid-Open No. 2005-121990, an end portion seal is bonded after a cleaning blade is attached. Thus, the end portion seal can be bonded to fit a side end surface. Therefore, adequate sealing properties can be secured. However, bonding of an auxiliary seal for sealing a back surface of the cleaning blade is required before the cleaning blade is attached. In other words, the end portion seal and the auxiliary seal are required to be separate components.

In the present exemplary embodiment, the end portion seal and the auxiliary seal are integrated as the elastic seal 64 (64L and 64R). Since the elastic seal 64 includes a back surface seal portion 641, the elastic seal 64 is required to be attached to the frame member 61 before the cleaning blade 62 is attached.

Specifically, in order to secure sealing properties of the side end surface facing portion 643 of the elastic seal 64 and the rubber member 621, the distance between one side end surface facing portion 643 and another side end surface facing portion 643 of the elastic seals 64L and 64R needs to be set shorter than the longitudinal dimension of the rubber member 621. In this state, when the cleaning blade 62 is attached to the frame member 61, the drum contact portion 642 may be pressed downward to the back surface contact portion 641 side by the side end portion of the rubber member 621. This may remove the drum contact portion 642 from the surface of the drum 2 to impair sealing properties.

However, in the present exemplary embodiment, the distance L2 between the side end surface facing portions 643 on the drum contact portion 642 side, which is the upstream side in the direction in which the cleaning blade 62 is attached, is longer than the distance L0 between the side end surfaces of the rubber member 621 of the cleaning blade 62. Thus, the drum contact portion 642 is not likely to be pressed downward.

As the foregoing describes, the present exemplary embodiment can provide the cleaning apparatus 6 that prevents the residues stored in the residue storage unit 66 from leaking from the opening portion 65 of the cleaning apparatus 6. Further, the cleaning apparatus 6 includes a smaller number of components, and is easy to attach.

Figure 7:
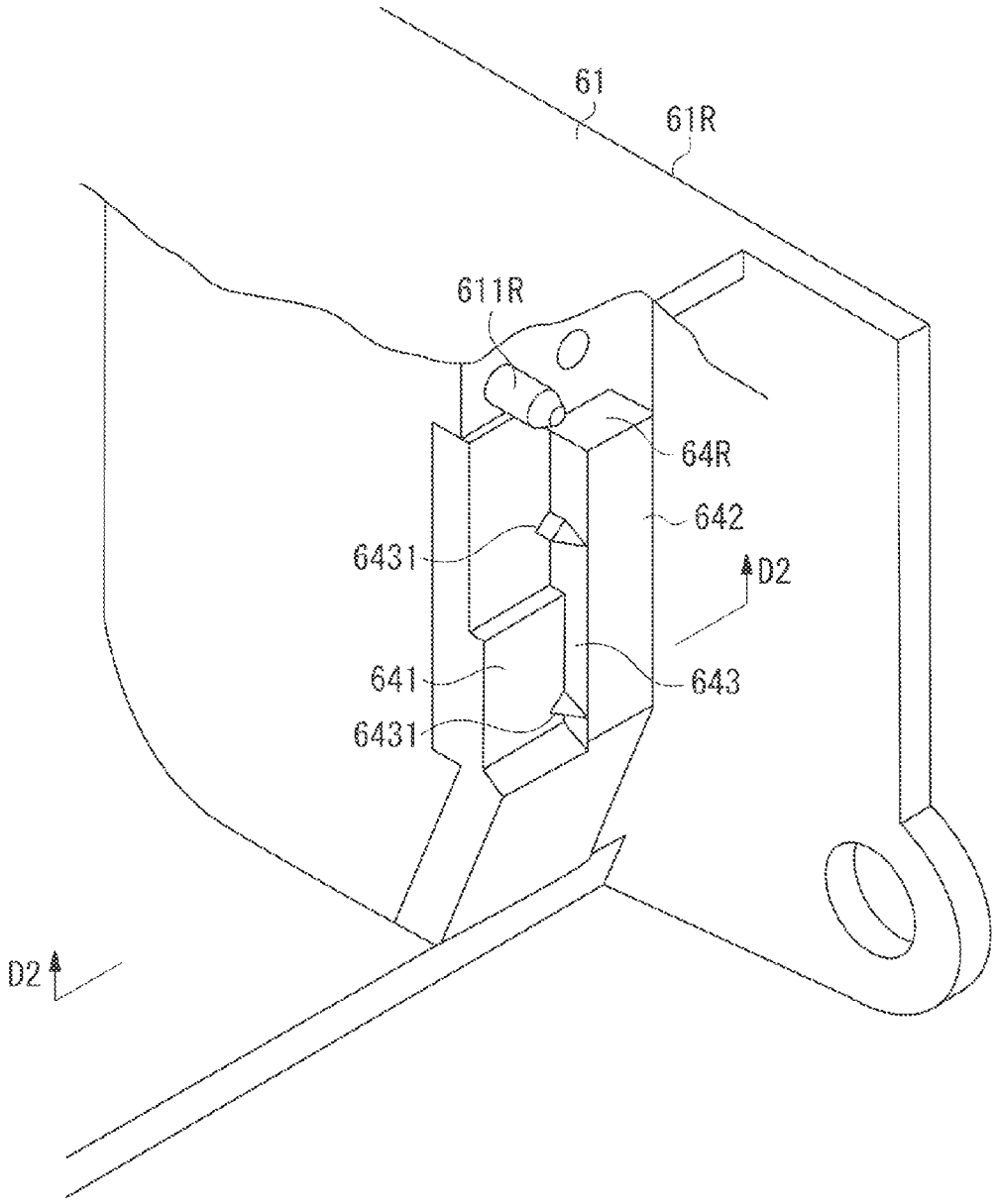
FIG. 7 is a partial enlarged view of a right elastic seal according to a second exemplary embodiment.

The following describes a second exemplary embodiment with reference to FIG. 7. Features of the second exemplary embodiment that are similar to those of the image forming apparatus 1 of the first exemplary embodiment and produce similar advantageous effects are denoted by the same reference numerals to omit description as appropriate.

FIG. 7 is a partial enlarged view of a right elastic seal 64R according to the second exemplary embodiment. A left elastic seal (64L) portion is omitted, but the left elastic seal (64L) and the right elastic seal 64R are symmetrical.

As illustrated in FIG. 7, protrusion portions 6431 are formed on a side end surface facing portion 643 connecting a back surface contact portion 641 to a drum contact surface 642. The amount of expansion of the protrusion portions 6431 from the side end surface facing portion 643 increases from the drum contact portion 642 toward the back surface contact portion 641.

The distance between top ends of the protrusion portions 6431 of the left and right elastic seals 64L and 64R is L1 on the back surface contact portion 641 side and L2 on the drum contact surface 642 side. The relationship between the longitudinal dimension L0 of the rubber member 621 and, L1, and L2 is L1<L0<L2 as in the first exemplary embodiment. In other words, the cross section along the line D2-D2 indicated in FIG. 7 has a similar shape to that in the first exemplary embodiment as illustrated in FIGS. 6A, 6B, and 6C.

Accordingly, as in the first exemplary embodiment, only side end surface contact portions 643*a* of the protrusion portions 6431, which are regions satisfying L1<L0, come into contact with the side end surfaces of the rubber member 621.

The rubber member 621 of the cleaning blade 62 is brought into contact with a surface of a drum 2 to scrape residues. At this time, it is desirable that a front edge of the rubber member 621 follows the drum 2.

According to the present exemplary embodiment, only the protrusion portions 6431 come into contact with the side end portions of the cleaning blade 62. Thus, the rubber member 621 is less likely to receive repulsive force from the elastic seal 64. Hence, cleaning performance of the cleaning blade 62 can be improved.

As described in the first exemplary embodiment, the elastic seal 64 (64L and 64R) is molded. Thus, a complicated shape such as the shape of the protrusion portions 6431 can be formed.

The elastic seal 64 of the second exemplary embodiment is summarized as follows. The side end surface contact portions 643*a* are the protrusion portions 6431 protruding from the side end surface facing portions 643 toward the direction of the side end surfaces of the cleaning blade 62. There is a space between the side end surface facing portion 643 and the side end surfaces of the cleaning blade 62.

Figure 8:
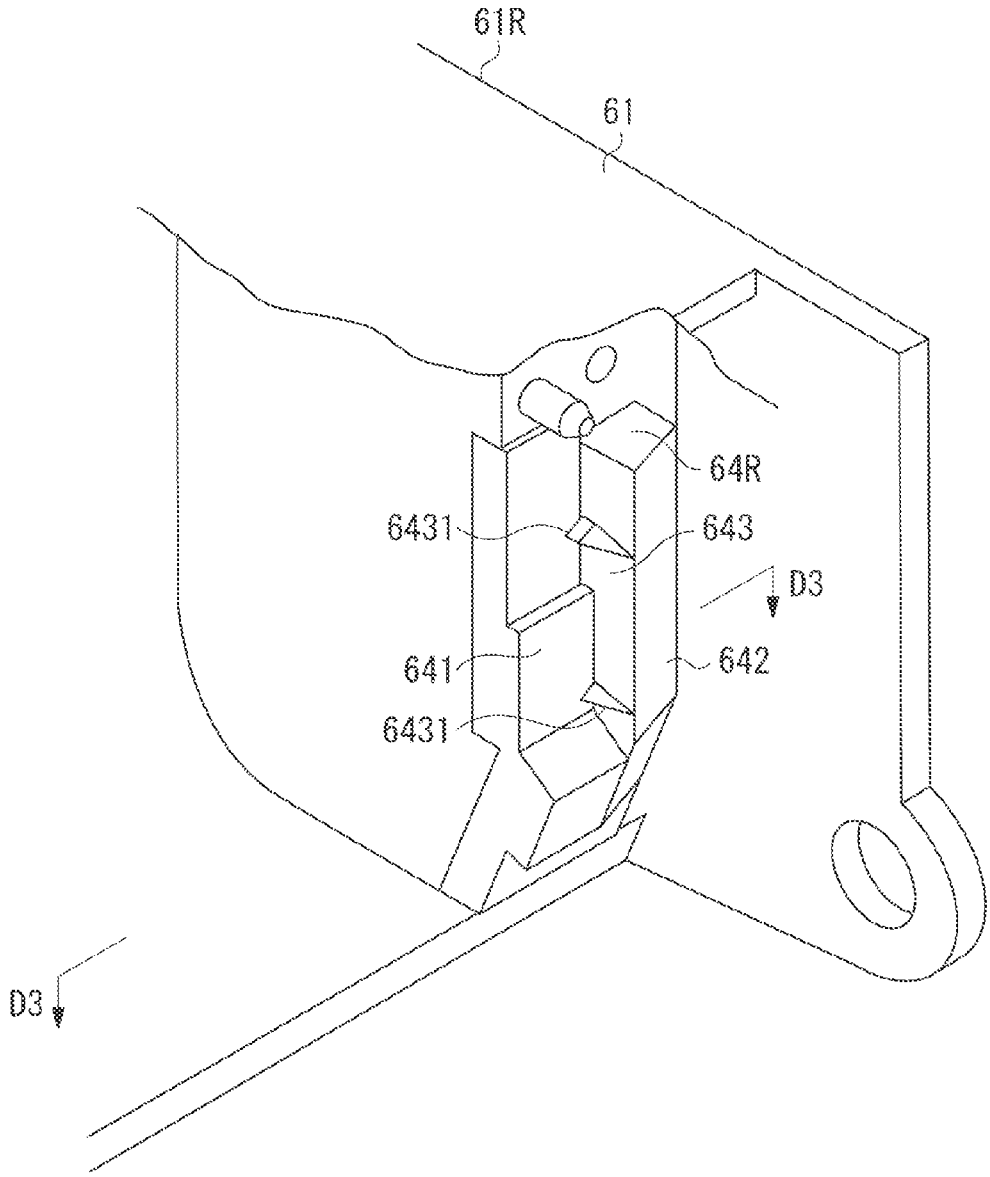
FIG. 8 is a partial enlarged view of an elastic seal on the right-hand side according to a third exemplary embodiment.
Figure 9A:
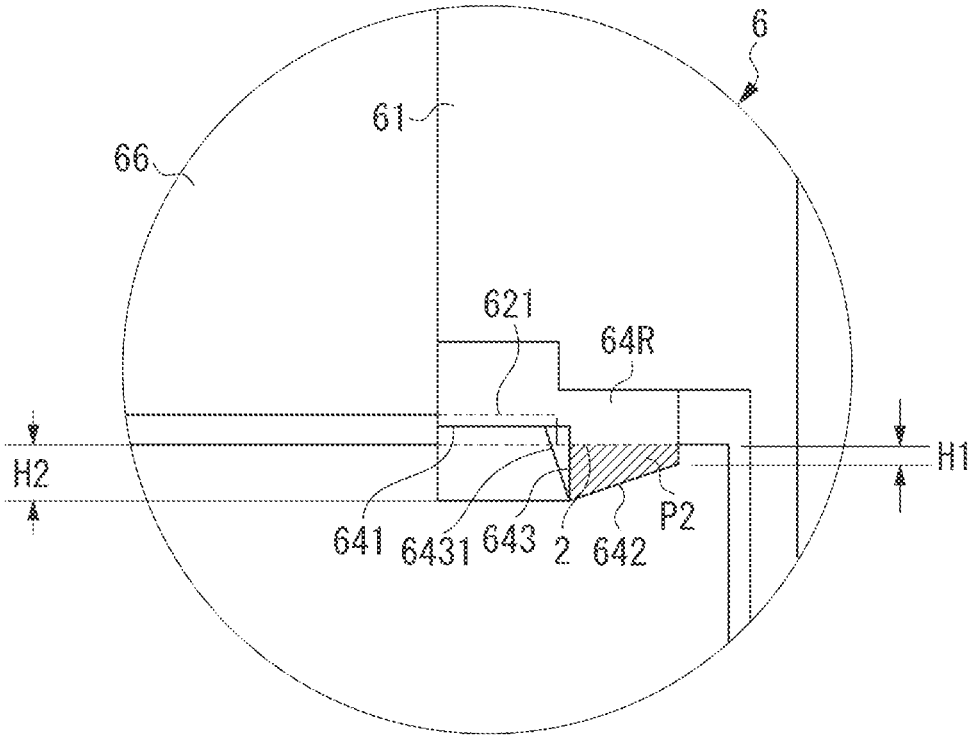
FIGS. 9A and 9B are partial cross sectional views along the line D3-D3 indicated in FIG. 8.
Figure 9B:
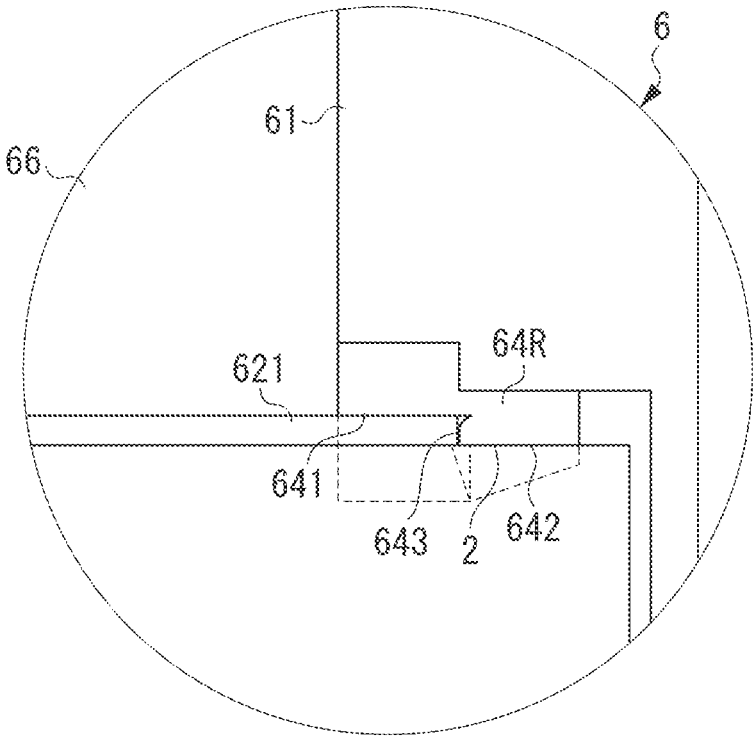

The following describes a third exemplary embodiment with reference to FIGS. 8, 9A, and 9B. Features of the third exemplary embodiment that are similar to those of the image forming apparatuses 1 of the first and second exemplary embodiments and produce similar advantageous effects are denoted by the same reference numerals to omit description as appropriate.

FIG. 8 is a partial enlarged view of a right elastic seal 64R of the present exemplary embodiment. As illustrated in FIG. 8, a drum contact portion 642 is an inclined surface with its inside being higher. A left elastic seal 64L portion is omitted, but the left elastic seal 64L and the right elastic seal 64R are symmetrical.

FIGS. 9A and 9B are partial cross sectional views along the line D3-D3 indicated in FIG. 8. FIG. 9A illustrates a state in which a drum 2 is attached to a frame member 61 of a cleaning apparatus 6. FIG. 9A illustrates a state of the elastic seal 64R before being compressed. FIG. 9B illustrates a state in which the elastic seal 64R is compressed by a rubber member 621 and the drum 2. In FIG. 9B, the shape of the elastic seal 64R before being compressed is shown in a dashed line.

As illustrated in FIG. 9A, the amount of compression of the drum contact surface 642 of the elastic seal 64 (64L and 64R) varies in the longitudinal direction of the drum 2. Specifically, the amount of compression of the drum contact portion in an outside is H1, and the amount of compression in an inside is H2. The amounts of compression satisfy H1<H2.

When the drum 2 is attached, since the amounts of compression H1 and H2 are different, the elastic seal 64 is pushed inside as illustrated in FIG. 9B. Consequently, a side end surface facing portion 643 is pushed toward the rubber member 621 so that a side end surface of the rubber portion 621 and the side end surface contact portion 643*a* come into closer contact with each other.

The drum contact portion 642 is not parallel to a back surface contact portion 641. However, since the elastic seal 64 is molded as described in the first exemplary embodiment, such a shape can be formed.

In the elastic seals 64 (64L and 64R) of the first and second exemplary embodiments, the amount of compression of the elastic seal 64 and the side end portion of the rubber member 621 decreases toward the drum contact portion 642. However, in the present exemplary embodiment, especially the drum contact portion 642 side is pushed inward so that a portion with a smaller amount of compression can be improved. Thus, a higher level of sealing properties can be secured.

Although according to the present exemplary embodiment, the side end surface facing portion 643 includes protrusion portions 6431, the shape described in the first exemplary embodiment can also be employed.

Further, according to the present exemplary embodiment, even when there is a space between the entire region of the side end surface facing portion 643 and the rubber member 621, contact properties of the side end surface facing portion 643 and the side end surface of the rubber member 621 can be secured.

The elastic seal 64 of the third exemplary embodiment is summarized as follows. The amount of compression of the drum contact portion 642 is set to vary in the longitudinal direction of the drum 2. The amount of compression of the inside of the drum contact portion 642 in the longitudinal direction of the drum 2 is set to be larger than the amount of compression of the outside of the drum contact portion 642 in the longitudinal direction of the drum 2. The drum contact portion 642 is compressed by the drum 2 to bring the side end surface contact portion 643*a* and a side end surface of a cleaning blade 62 into contact with each other.

The following describes a fourth exemplary embodiment with reference to FIGS. 10A, 10B, 10C, 11A, 11B, and 11C. Features of the fourth exemplary embodiment that are similar to those of the image forming apparatus 1 of the first exemplary embodiment and produce similar advantageous effects are denoted by the same reference numerals to omit description as appropriate.

The first exemplary embodiment employs the method in which the elastic seal 64 (64L and 64R) molded in advance is fixed to the fixing seat surface 613. On the other hand, the present exemplary embodiment employs a method in which an elastic seal 64 is molded directly on a fixing seat surface 613. In other words, the elastic seal 64 is a molded component that is molded directly on a frame member 61.

[Structures of Mold and Fixing Seat Surface]

Figure 10A:
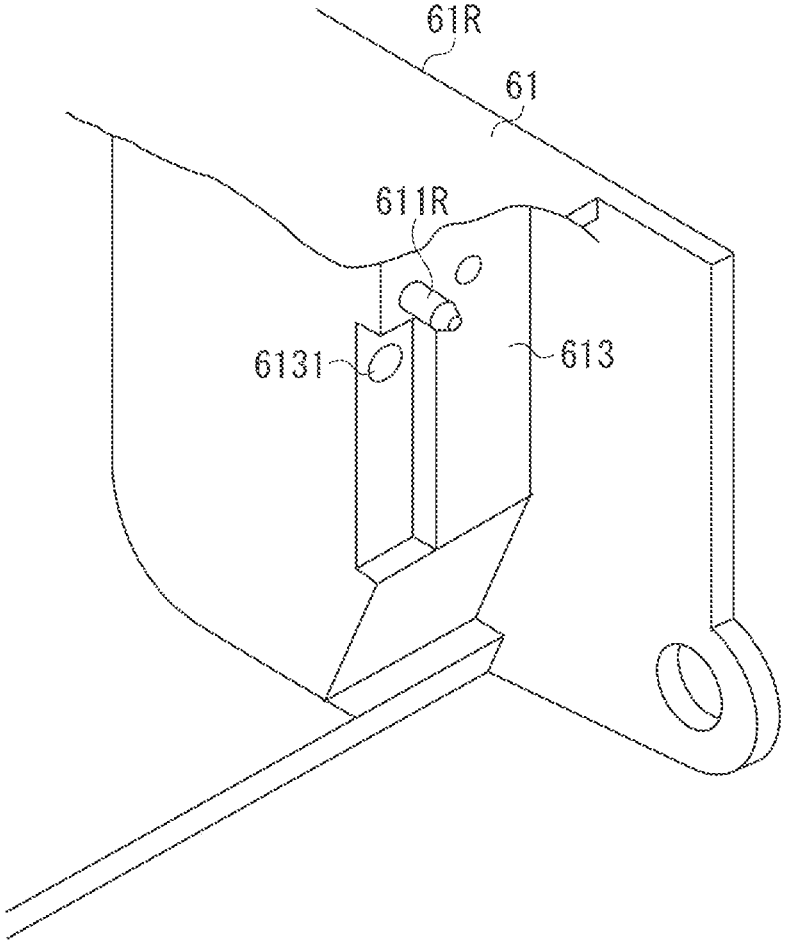
FIGS. 10A, 10B, and 10C are partial enlarged views illustrating portions around a fixing seat surface on the right-hand side.
Figure 10B:
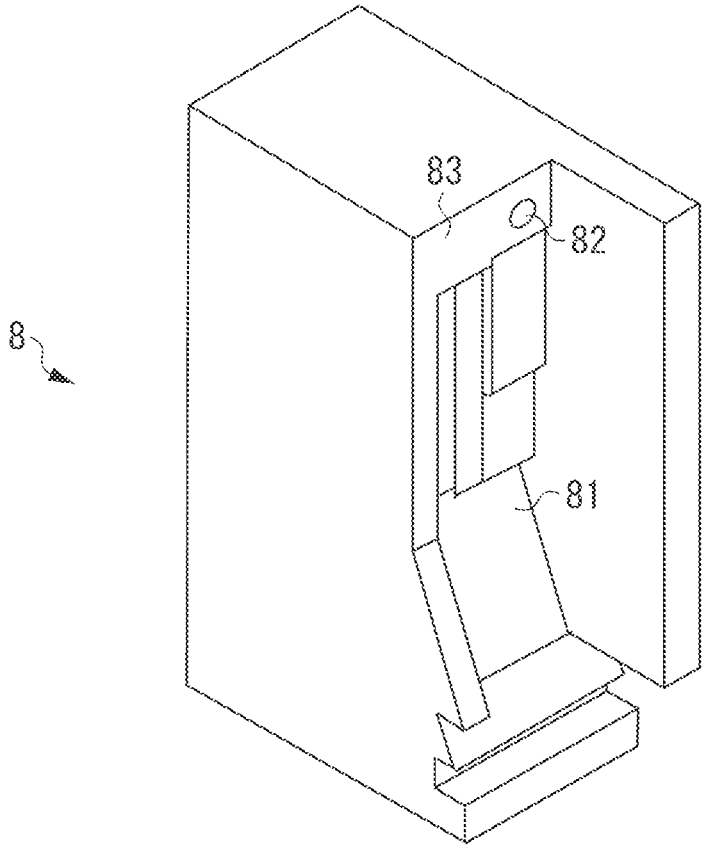
Figure 10C:
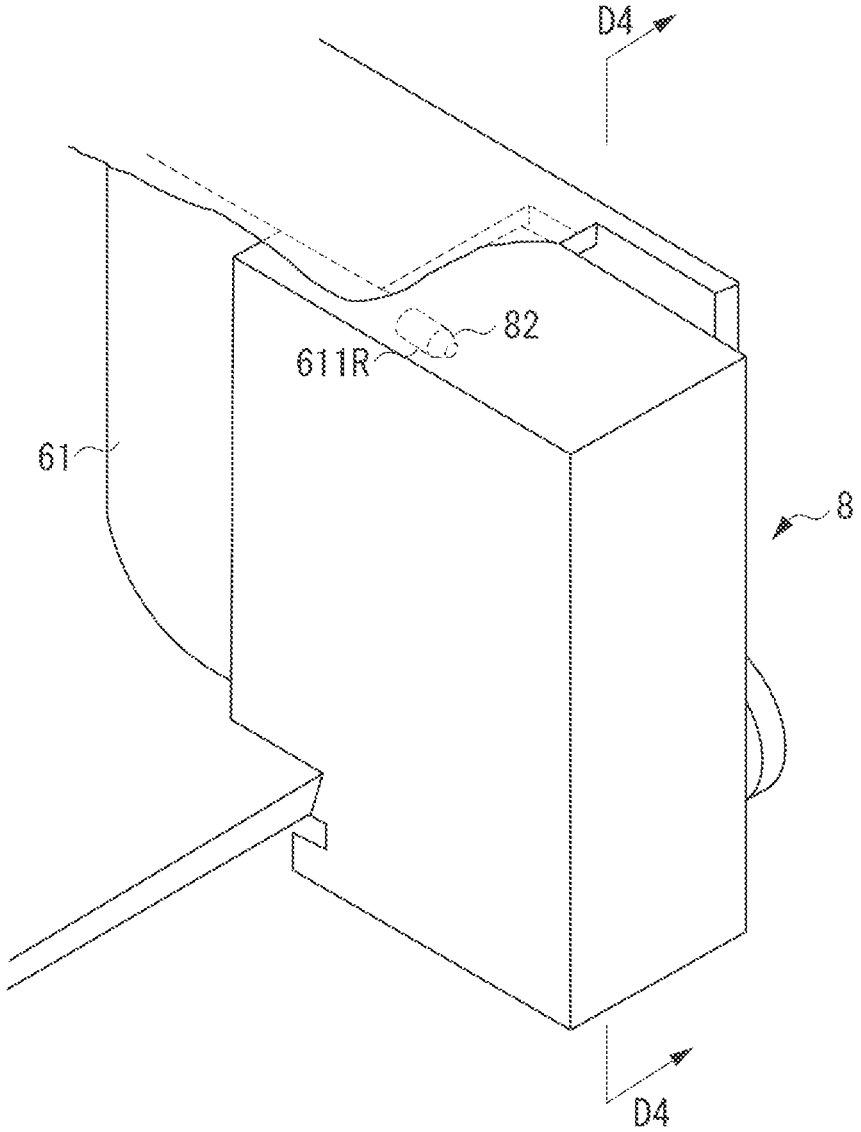

FIGS. 10A, 10B, and 10C are partial enlarged views illustrating portions around the fixing seat surface 613 of the frame member 61 on the right-hand side. FIG. 10A illustrates the fixing seat surface 613 of the present exemplary embodiment. FIG. 10B is a perspective view of a mold 8 viewed from a contact surface 83 side which comes into contact with the cleaning frame member 61. Details of the mold 8 will be described below. FIG. 10C illustrates a state in which the mold 8 is in contact with the fixing seat surface 613 of the cleaning frame member 61. A left fixing seat surface 613 portion is omitted, but the left fixing seat surface 613 and the right fixing seat surface 613 are symmetrical.

As illustrated in FIG. 10A, a positioning boss 611R is disposed near the fixing seat surface 613. The positioning boss 611R is a positioning member of the cleaning blade 62. In the fixing seat surface 613, a buffer hole 6131 is formed. Details of the buffer hole 6131 will be described later. As illustrated in FIG. 10B, the mold 8 includes the contact surface 83, which comes into contact with the cleaning frame member 61, a mold positioning hole 82, with which the positioning boss 611R is to be engaged, and a cavity portion 81 having the shape of the elastic seal 64R. As illustrated in FIG. 10C, the mold 8 is molded while being in contact with the cleaning frame member 61.

[Molding of Elastic Seal]

Figure 11A:
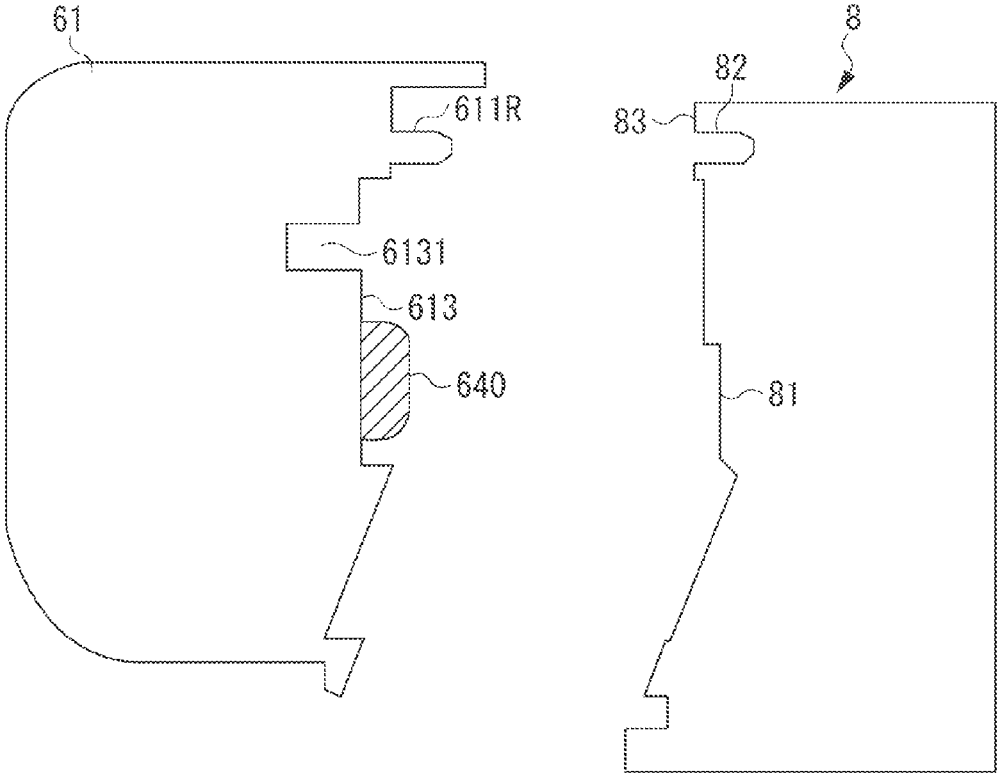
FIGS. 11A, 11B, and 11C are cross sectional views along the line D4-D4 indicated in FIG. 10C.
Figure 11B:
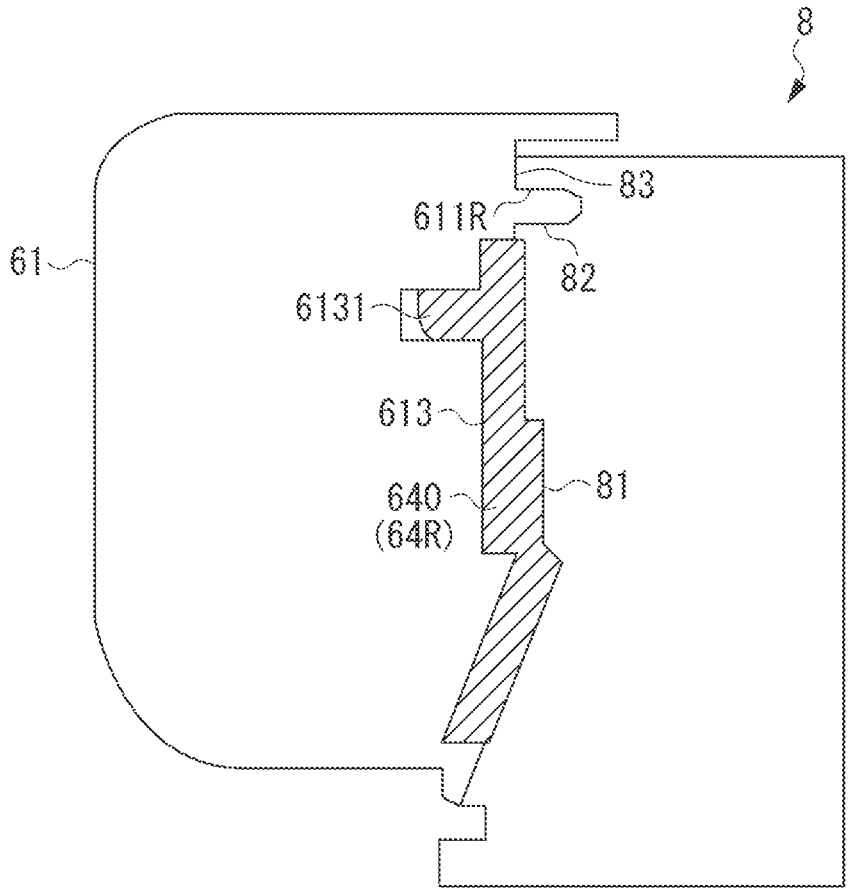
Figure 11C:
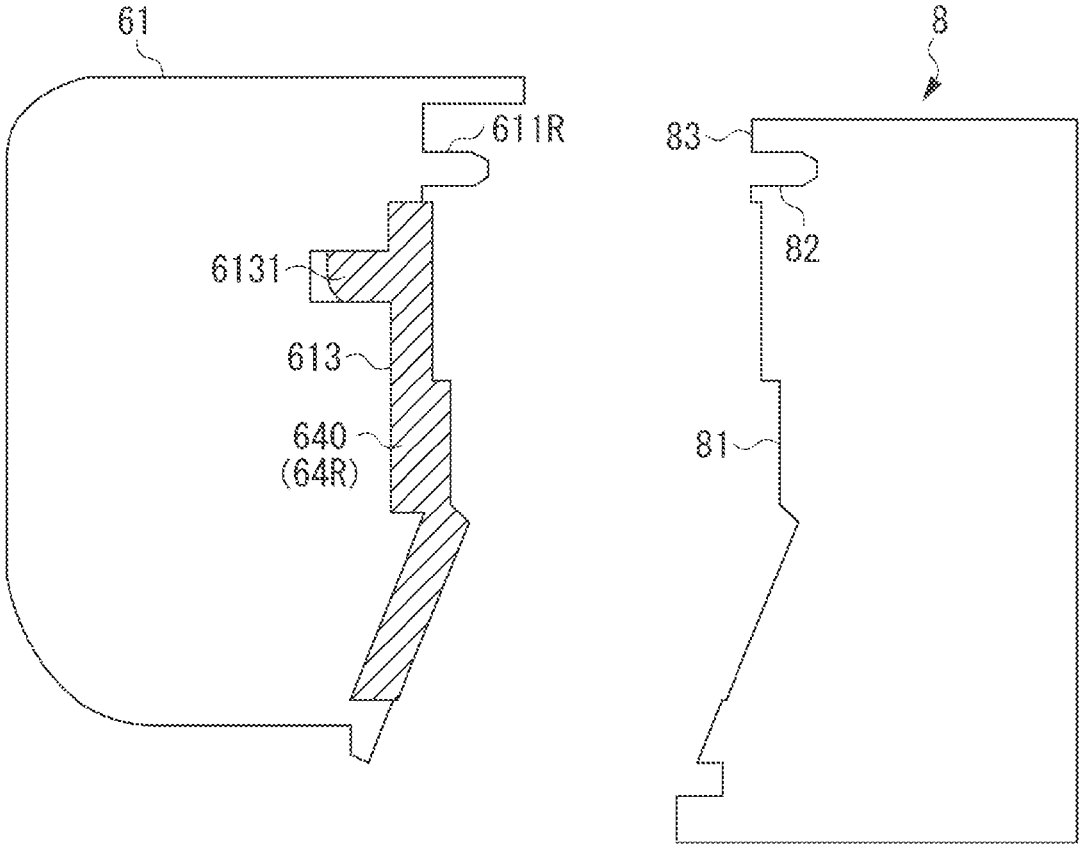

The following describes molding of the elastic seal 64 (64L and 64R) with reference to FIGS. 11A, 11B, and 11C. FIGS. 11A, 11B, and 11C are cross sectional views along the line D4-D4 indicated in FIG. 10C. FIG. 11A illustrates a state in which the mold 8 is removed from the cleaning frame member 61 and a coating agent 640 is applied to the fixing seat surface 613. Details of the coating agent 640 will be described later. FIG. 11B illustrates a state in which the contact surface 83 of the mold 8 is in contact with the cleaning frame member 61. FIG. 11C illustrates a state in which the mold 8 is removed from the cleaning frame member 61 and the elastic seal 64 is formed.

As illustrated in FIG. 11A, while the mold 8 is removed from the cleaning frame member 61, a thermoplastic foamed elastomer 640 is applied. The coating agent 640 is a thermoplastic foamed elastomer. Examples of a thermoplastic foamed elastomer include a thermoplastic foamed elastomer prepared by mixing a high pressure inert gas such as nitrogen with an ether based urethane resin. Such a thermoplastic foamed elastomer starts foaming once released into the atmosphere.

As illustrated in FIG. 11B, after the coating agent 640 is applied, the mold 8 is promptly moved to the cleaning frame member 61 to bring the contact surface 83 into contact with the cleaning frame member 61. At this time, the positioning boss 611R formed on the cleaning frame member 61 is engaged with the mold positioning hole formed in the mold 8 to position the mold 8 on the cleaning frame member 61.

The coating agent 640 foams in a space formed by the fixing seat surface 613 and the cavity portion 81 to come into close contact with the fixing seat surface 613 and the cavity portion 81. At this time, the excessive coating agent 640 flows into a buffer hole 6131. The amount of the applied coating agent 640 and the coefficient of expansion in foaming may vary to some extent. The buffer hole 6131 is formed to absorb this variation. In other words, the buffer hole 6131 is formed in the fixing seat surface 613 to obtain the elastic seal 64R with stable shape and elasticity.

When the shape of the cavity portion 81 is transferred to the coating agent 640 and stabilized, the mold 8 is removed from the cleaning frame member 61 as illustrated in FIG. 11C. By this way, the elastic seal 64R can be molded directly on the fixing seat surface 613. The left elastic seal 64L can be molded similarly to the molding of the right elastic seal 64R, except that the shape is mirror-reversed.

Thus, the elastic seal 64 (64L and 64R) is molded directly on the fixing seat surface 613, so that contact properties of the fixing seat surface 613 and the elastic seal 64 can be secured. The mold 8 is positioned by the positioning bosses 611L and 611R of the cleaning blade 62 so that the dimensions of the elastic seal 64 and the cleaning blade 62 can be managed with high accuracy.

The elastic seal 64 can be formed by two-color molding on the fixing seat surface 613.

[Skin Layer of Elastic Seal]

Figure 12A:
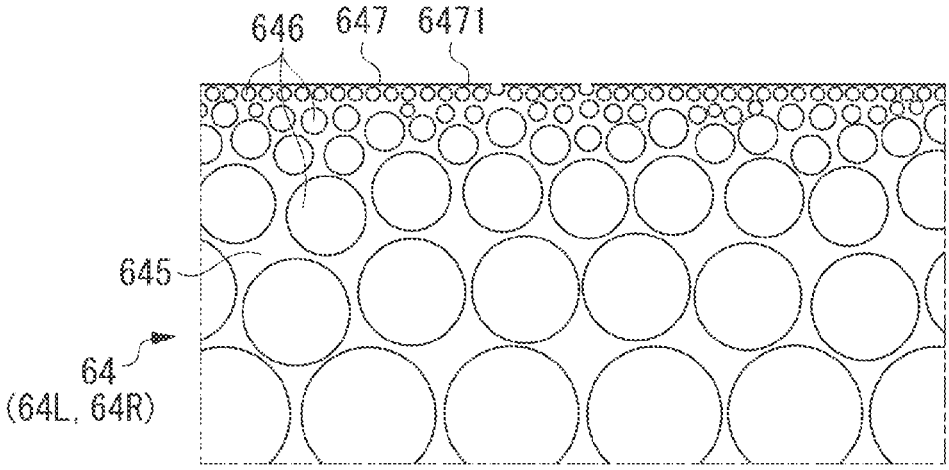
FIGS. 12A and 12B are schematic views illustrating partial cross sections illustrating a surface layer and an inside portion of an elastic seal.
Figure 12B:
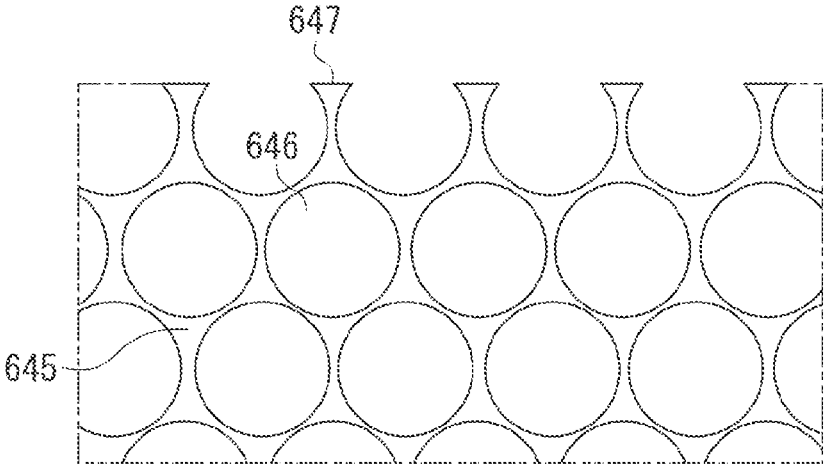

The following describes a surface layer of the elastic seal (64L and 64R) with reference to FIGS. 12A and 12B. FIGS. 12A and 12B are schematic views illustrating partial cross sections illustrating a surface layer and an inside portion of the elastic seal 64. FIG. 12A illustrates a sealing member obtained by molding the elastic seal 64 with the mold 8, as described in the present exemplary embodiment. FIG. 12B illustrates a sealing member formed by cutting a foamed urethane sheet, as described in the first exemplary embodiment, for example.

As illustrated in FIG. 12A, cells 646, which are bubbles, are formed in a base material layer 645 of the elastic seal 64. The cells 646 are an expanded high pressure inert gas which is contained in the coating agent 640. When the coating agent 640 foams, the coating agent 640 is pressed by the cavity portion 81. At this time, strong pressure is applied to the coating agent 640. Thus, the cells 646 near the surface layer 647 are decreased in size. Consequently, a skin layer 6471 with a smooth surface is formed on a surface layer 647.

On the other hand, as illustrated in FIG. 12B, in the case of a foamed urethane sheet, while the base material layer 645 and the cells 646 are formed, no skin layer is formed on the surface layer 647. A general foamed urethane sheet is prepared by slicing a large foamed urethane foam into slices with a predetermined thickness. At this time, a surface layer portion is eliminated to expose the base material layer 645 and the cells 646 on the surface.

Since the skin layer 6471 is formed to have a smooth surface, high contact properties can be secured. In other words, the skin layer 6471 is formed on the side end surface contact portion 643*a* so that sealing properties of a side end surface of a rubber member 621 and the elastic seal 64 can be improved. The elastic seal 64 of the present exemplary embodiment includes the skin layer 6471 at least on a surface of a side end surface contact portion 643*a*.

As described in the first to third exemplary embodiments, the skin layer 6471 can be formed on a surface of the elastic seal 64 molded in advance with a metallic mold. Accordingly, a similar advantageous effect can be produced with respect to the side end surface contact portions 643*a* of the first to third exemplary embodiments.

As the foregoing describes, the elastic seal 64 is molded directly on the fixing seat surface 613 in the present exemplary embodiment, so that the relative positions of the cleaning blade 62 and the elastic seal 64 can be managed with high accuracy.

Further, the cleaning blade 62 and the drum 2 are attached after the shape of the elastic seal 64 is stabilized, so that there would be no constraint during the process of attaching the cleaning apparatus 6.

The cartridge 9 (FIG. 1) is removably attached to the main body of the image forming apparatus 1 and is configured to contribute to an image forming process.

A process cartridge integrates at least one of a charging unit, a development unit, and a cleaning unit as image forming process units with an image bearing member. The process cartridge is removably attached to the main body of the image forming apparatus. Accordingly, the process cartridge includes a cartridge in which a development unit as a process unit and an image bearing member are integrated and which is removably attached to a main body of an image forming apparatus.

The process cartridge also includes a cartridge in which a charging unit, a development unit, or a cleaning unit as a process unit, and an image bearing member are integrated and which is removably attached to a main body of an image forming apparatus.

A process cartridge in which an image bearing member and a development unit are integrated is referred to as an integrated cartridge. A process cartridge in which an image bearing member and a process unit other than a development unit are integrated is referred to as a separation type process cartridge.

A user can attach and remove the process cartridge to and from a main body of an apparatus. This enables easy maintenance of a main body of an apparatus. The image forming process units act on the image bearing member.

A development cartridge includes a development member that applies a developer (toner) to an image bearing member. The development member stores the developer to be used by the development member to develop a latent image formed on the image bearing member. The developer cartridge is removably attached to a main body of an apparatus.

In the case of a development cartridge, an image bearing member is attached either to a main body of an apparatus or to a cartridge supporting member. Alternatively, an image bearing member is provided in a separation type process cartridge (in this case, the process cartridge does not include a development unit). The development cartridge can also be attached to and removed from a main body of an apparatus by a user. Thus, maintenance of the main body of the apparatus can be performed with ease.

Examples of a cartridge include an integrated process cartridge and a separation type process cartridge described above. The cartridge includes a cartridge using a pair of a separation type process cartridge and a development cartridge. The cartridge also includes a cartridge in which an image bearing member is fixed and attached to a main body of an apparatus or a cartridge supporting member such that the development cartridge can be removably attached to act on the image bearing member.

In the exemplary embodiments of the present invention, the cartridge 9 at least includes a cleaning unit (cleaning apparatus) and is removably attached to a main body of the image forming apparatus 1.

The present invention can provide a cleaning apparatus that secures adequate sealing properties with a smaller number of components than that of a conventional apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-171033 filed Aug. 1, 2012, which is hereby incorporated by reference herein in its entirety.

What is claimed is:

1. A cleaning apparatus comprising: a cleaning blade being in contact with a surface of an image bearing member to remove a residue from the surface of the image bearing member wherein a developer image is formed on the surface of the image bearing member; and a cleaning frame member including a residue collecting unit configured to collect the residue removed by the cleaning blade, wherein the cleaning apparatus comprises an elastic seal disposed at an end portion of the cleaning blade in a longitudinal direction, wherein the elastic seal is an integrated seal including an image bearing member contact portion and a side end surface facing portion that faces a side end surface of the cleaning blade and includes a side end surface contact portion which comes into contact with the side end surface of the cleaning blade when the cleaning blade is attached to the cleaning frame member, wherein a distance between the side end surface facing portion of the elastic seal and a corresponding portion on another side that corresponds to the side end surface facing portion, is set longer at least on a side adjacent to the image bearing member contact portion than a longitudinal dimension of the cleaning blade, and wherein a distance between the side end surface contact portion of the elastic seal and a corresponding portion on another side that corresponds to the side end surface contact portion is set shorter than the longitudinal dimension of the cleaning blade.

2. The cleaning apparatus according to claim 1, wherein the elastic seals are disposed in a pair at one end side and another end side of the cleaning blade in the longitudinal direction, wherein a distance between one side end surface facing portion and another side end surface facing portion in the pair of elastic seals is set longer at least on a side adjacent to the image bearing member contact portion than the longitudinal dimension of the cleaning blade, and wherein a distance between the one side end surface contact portion and another side end surface contact portion in the pair of elastic seals is set shorter than the longitudinal dimension of the cleaning blade.

3. The cleaning apparatus according to claim 1, wherein the elastic seal includes a back surface contact portion which is brought into contact with a back surface of the cleaning blade, and wherein the back surface contact portion is disposed downstream from the image bearing member contact portion in a direction in which the cleaning blade is attached.

4. The cleaning apparatus according to claim 3, wherein a distance between the side end surface contact portion of the elastic seal and a corresponding portion on another side that corresponds to the side end surface contact portion, is set shorter than the longitudinal dimension of the cleaning blade at least in a region where a dimension from the back surface contact portion is equal to or greater than a thickness of the side end surface of the cleaning blade.

5. The cleaning apparatus according to claim 3, wherein a distance between the side end surface contact portion of one elastic seal and the side end surface contact portion of another elastic seals set shorter than the longitudinal dimension of the cleaning blade at least in a region where a dimension from the back surface contact portion is equal to or greater than a thickness of the side end surface of the cleaning blade.

6. The cleaning apparatus according to claim 1, wherein the elastic seal includes a skin layer at least on a surface of the side end surface contact portion.

7. The cleaning apparatus according to claim 1, wherein the side end surface contact portion is a protrusion portion protruding from the side end surface facing portion in a direction of the side end surface of the cleaning blade, and wherein there is a space between the side end surface facing portion and the side end surface of the cleaning blade.

8. The cleaning apparatus according to claim 1, wherein a compression amount of the image bearing member contact portion is set to vary in a longitudinal direction of the image bearing member, wherein the compression amount of an inside of the image bearing member contact portion in the longitudinal direction is set to be larger than the compression amount of an outside of the image bearing member contact portion in the longitudinal direction, and wherein the image bearing member contact portion is compressed by the image bearing member to bring the side end surface contact portion and the side end surface of the cleaning blade into contact with each other.

9. The cleaning apparatus according to claim 1, wherein the elastic seal is molded directly on the cleaning frame member.

10. A cartridge removably attached to a main body of an image forming apparatus, the cartridge comprising at least the cleaning apparatus according to claim 1.

11. An image forming apparatus comprising:

an image bearing member on which a developer image is formed; and a cleaning unit configured to remove a residue from a surface of the image bearing member, wherein the cleaning unit includes the cleaning apparatus according to claim 1.

12. An integrated elastic seal disposed at an end portion in a longitudinal direction of a cleaning blade of a cleaning apparatus including: the cleaning blade contacting a surface of an image bearing member to remove a residue from the surface of the image bearing member wherein a developer image is formed on the surface of the image bearing member; and a cleaning frame member including a residue collecting unit configured to collect the residue removed by the cleaning blade, the integrated elastic seal including an image bearing member contact portion which is brought into contact with the image bearing member and a side end surface facing portion facing a side end surface of the cleaning blade, wherein the side end surface facing portion includes a side end surface contact portion which comes into contact with the side end surface of the cleaning blade when the cleaning blade is attached to the cleaning frame member, wherein a distance between the one side end surface facing portion and a corresponding portion on a side that corresponds to another side end surface facing portion is set longer at least on a side adjacent to the image bearing member contact portion than a longitudinal dimension of the cleaning blade, and wherein a distance between the one side end surface contact portion and a corresponding portion that corresponds to another side end surface contact portion is set shorter than the longitudinal dimension of the cleaning blade.

13. The elastic seal according to claim 12, wherein the elastic seals are disposed in a pair at one end side and another end side of the cleaning blade in the longitudinal direction, wherein a distance between the side end surface facing portion of one elastic seal and the side end surface facing portion of another elastic seal is set longer at least on a side adjacent to the image bearing member contact portion than the longitudinal dimension of the cleaning blade, and wherein a distance between the side end surface contact portion of one elastic seal and the side end surface contact portion of another elastic seal is set shorter than the longitudinal dimension of the cleaning blade.

14. The elastic seal according to claim 12, further comprising a back surface contact portion which is brought into contact with a back surface of the cleaning blade, wherein the back surface contact portion is disposed downstream from the image bearing member contact portion in a direction in which the cleaning blade is attached.

15. The elastic seal according to claim 14, wherein a distance between the side end surface contact portion and a corresponding portion that corresponds to another side end surface contact portion is set shorter than the longitudinal dimension of the cleaning blade at least in a region where a dimension from the back surface contact portion is equal to or greater than a thickness of the side end surface of the cleaning blade.

16. The elastic seal according to claim 14, wherein a distance between the side end surface contact portion of one elastic seal and the side end surface contact portion of another elastic seal is set shorter than the longitudinal dimension of the cleaning blade at least in a region where a dimension from the back surface contact portion is equal to or greater than a thickness of the side end surface of the cleaning blade.

17. The elastic seal according to claim 12, further comprising a skin layer at least on a surface of the side end surface contact portion.

18. The elastic seal according to claim 12, wherein the side end surface contact portion is a protrusion portion protruding from the side end surface facing portion in a direction of the side end surface of the cleaning blade, and wherein there is a space between the side end surface facing portion and the side end surface of the cleaning blade.

19. The elastic seal according to claim 12, wherein a compression amount of the image bearing member contact portion is set to vary in a longitudinal direction of the image bearing member, wherein the compression amount of an inside of the image bearing member contact portion in the longitudinal direction is set to be larger than the compression amount of an outside of the image bearing member contact portion in the longitudinal direction, and wherein the image bearing member contact portion is compressed by the image bearing member to bring the side end surface contact portion and the side end surface of the cleaning blade into contact with each other.

20. The elastic seal according to claim 12, wherein the elastic seal is molded directly on the cleaning frame member.

* * * * *